US006997730B2

(12) United States Patent
Baker et al.

(10) Patent No.: US 6,997,730 B2
(45) Date of Patent: Feb. 14, 2006

(54) HIGH CURRENT ELECTRICAL CONNECTOR SYSTEM AND METHODS THEREOF

(75) Inventors: Craig Harold Baker, Shrewsbury, MA (US); Danna Anthony Mancini, Worcester, MA (US); Urs Felix Nager, Hudson, NH (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/435,801

(22) Filed: May 12, 2003

(65) Prior Publication Data

US 2003/0216075 A1 Nov. 20, 2003

Related U.S. Application Data

(60) Provisional application No. 60/381,840, filed on May 17, 2002.

(51) Int. Cl.
*H01R 25/00* (2006.01)

(52) U.S. Cl. ..... 439/295; 439/603; 439/595; 439/744; 439/871; 439/310; 439/284; 439/290

(58) Field of Classification Search ..... 439/744, 439/310, 729, 739, 284, 595, 871, 603, 290, 439/295

See application file for complete search history.

(56) References Cited

U.S. PATENT DOCUMENTS

| | | | | | |
|---|---|---|---|---|---|
| 3,091,746 | A | * | 5/1963 | Winkler | 439/295 |
| 3,218,599 | A | * | 11/1965 | Winkler | 439/295 |
| 4,083,617 | A | * | 4/1978 | Wyatt | 439/295 |
| 4,147,400 | A | * | 4/1979 | Snyder, Jr. et al. | 439/744 |
| 4,335,931 | A | * | 6/1982 | Kinnear | 439/295 |
| 4,790,777 | A | * | 12/1988 | Iimori et al. | 439/744 |
| 5,106,320 | A | * | 4/1992 | Kinnear | 439/295 |
| 5,478,250 | A | | 12/1995 | Hoffman | |
| 6,077,117 | A | | 6/2000 | Iwahori | |
| 6,152,768 | A | * | 11/2000 | Beugnot et al. | 439/595 |
| 6,171,146 | B1 | | 1/2001 | Fink et al. | |
| 6,179,660 | B1 | | 1/2001 | Salaguinto et al. | |

* cited by examiner

*Primary Examiner*—Tho D. Ta
(74) *Attorney, Agent, or Firm*—Nixon Peabody LLP

(57) ABSTRACT

An electrical connector includes a first cable contact with a mating surface and a retaining surface, a housing, a retaining device, and at least one groove. The housing defines a first passage for receiving the first cable contact, a second passage for mating with a portion of a second cable contact, and an opening which extends to one end of the first passage. The retaining device is mounted in the first passage and engages with at least a portion of the retaining surface of the first cable contact to detachably retain the first cable contact in the first passage. The groove is formed in the retaining surface of the first cable contact. The opening in the housing is in communication with the groove.

31 Claims, 8 Drawing Sheets

HIGH CURRENT ELECTRICAL CONNECTOR SYSTEM AND METHODS THEREOF

This application claims the benefit of U.S. Provisional Patent Application Ser. No. 60/381,840 filed May 17, 2002 which is herein incorporated by reference in its entirety.

FIELD OF THE INVENTION

This invention relates generally to electrical connectors and, more particularly, to a high current electrical connector system.

BACKGROUND OF THE INVENTION

Typically, a fully charged battery provides less than eight hours of operating time and then requires eight hours to recharge. If a customer allows the battery to cool after charging for eight hours, as recommended by the manufacturers, each battery can only be used for a single eight-hour shift per day. As a result, users who want the benefits of electric vehicles, but need to operate more than one shift need elaborate battery handling equipment and "battery rooms" where batteries can be changed and charged outside the vehicle to permit these vehicles to be used for consecutive eight hour shifts.

Fast or opportunity charging allows a battery-powered industrial vehicle to continue operating longer and for more total hours than conventional battery charging. For example, instead of a fork lift truck in a warehouse having to go offline to switch battery packs at regular intervals, one pack charges while the other is used, the battery pack stays in the truck and can stay in operation with charging occurring during employee breaks and other lulls in activity. This translates into higher productivity. Additionally, fast charging eliminates the need for battery changing and thus the capital costs of extra batteries, battery changing equipment, floor space, and racking. Eliminating battery changing also reduces operating expenses by reducing the need for trained operators for these changing and charging activities.

Fast charging improves energy efficiency and reduces energy costs, because the fast chargers themselves are more efficient than non fast/opportunity charging chargers and because opportunity charging with less frequent overcharging increases the coulombic and energy efficiency of the battery. Additionally, opportunity charging with a fast charger can keep the battery at a higher average state of charge, which helps to increase lift truck performance and speed. Operating at a higher state of charge (SOC) also reduces maintenance costs that are correlated with the higher currents and component temperatures encountered during low voltage/SOC operation.

Although fast or opportunity charging provides a number of benefits, it also poses some challenges. Chargers used for fast or opportunity charging operate at much higher current levels than traditional systems and thus require connectors and cables capable of handling higher current loads. Additionally, these connectors need to be easy to connect and disconnect during use and should be easy to assemble and maintain.

SUMMARY OF THE INVENTION

An electrical connector in accordance with one embodiment of the present invention includes a housing, a first cable contact with a mating surface and a retaining surface, a retaining device, and at least one groove. The housing defines a first passage for receiving the first cable contact, a second passage for mating with a portion of a second cable contact, and an opening which extends to one end of the first passage. The retaining device is mounted in the first passage and engages with at least a portion of the retaining surface of the first cable contact to detachably retain the first cable contact in the first passage. The groove is formed in the retaining surface of the first cable contact. The opening in the housing is in communication with the groove.

An electrical connection system in accordance with another embodiment of the present invention includes a first housing, a second housing, a first cable contact, a second cable contact, a first retaining device, a second retaining device, a first groove, a second groove, and a lever system. The first cable contact has a first mating surface and a first retaining surface and the second cable contact has a second mating surface and a second retaining surface. The first housing defines a first passage for the first cable contact, a second passage for mating with a portion of the second cable contact, and a first opening which extends to one end of the first passage. The second housing defines a third passage for the second cable contact, a fourth passage for mating with a portion of the first cable contact, and a second opening which extends to one end of the third passage. A portion of the first housing with the second passage detachably mates with a portion of the second housing with the fourth passage to couple the first and second cable contacts together. A first retaining device is mounted in the first passage and engages with at least a portion of the first retaining surface of the first cable contact to detachably retain the first cable contact in the first passage. The second retaining device is mounted in the second passage and engages with at least a portion of the second retaining surface of the second cable contact to detachably retain the second cable contact in the third passage. The first groove is formed in the first retaining surface of the first cable contact. The first opening in the first housing is in communication with the first groove. The second groove is formed in the second retaining surface of the second cable contact. The second opening in the second housing is in communication with the second groove. The lever system is pivotally connected to the first and second housings for connecting and disconnecting the first and second housings and the first and second cable contacts.

A method for making an electrical connector in accordance with another embodiment of the present invention includes inserting a first cable contact with a mating surface and a retaining surface in a first passage in a first housing. The first housing has an opening which extends to one end of the first passage. The retaining surface of the first cable contact is engaged with a first retaining device mounted in the first passage to detachably retain the first cable contact in the first passage. At least one first groove is formed in the retaining surface of the first cable contact. The opening in the first housing is in communication with the first groove.

A method of making an electrical connection in accordance with another embodiment of the present invention includes inserting a first cable contact with a mating surface and a retaining surface in a first passage in a first housing. The first housing has an opening which extends to one end of the first passage and has a third passage with a portion of the first cable contact for mating with a portion of a second cable contact. The retaining surface of the first cable contact is engaged with a first retaining device mounted in the first passage to detachably retain the first cable contact in the first passage. At least one first groove is formed the retaining surface of the first cable contact. The opening in the first housing is in communication with the first groove. The second cable contact with a mating surface and a retaining surface in a second passage is inserted in a second housing. The second housing has an opening which extends to one end of the second passage and has a fourth passage with the portion of the second cable contact for mating with the portion of the first cable contact. The retaining surface of the second cable contact is engaged with a second retaining device mounted in the second passage to detachably retain the second cable contact in the second passage. At least one second groove is formed in the retaining surface of the second cable contact. The opening in the second housing is in communication with the second groove. The third and fourth passages of the first and second housings are detachably mated together to couple the first and second cable contacts together The present invention provides an electrical connection system for fast or opportunity charging, or high amperage power connection, that is as easy to assemble and disassemble as prior electrical connection systems of lower amperage ratings. Additionally, the present invention provides an electrical connection system that is easy to connect and disconnect during fast or opportunity charging, or high amperage power connection.

The present invention also provides a mechanism, a user customizable auxiliary housing, for mounting auxiliary functions and features such as battery monitoring of the fast or opportunity charging operations, air or water conduits, current presence indication, and an electromechanical interlock. The auxiliary housing, which mounts in the central passage of the connector, can provide up to ten (10) 45 amp circuits for battery monitoring of temperature, state of charge, charge history, and voltage. These circuits can also be used for data collection and system control functions. Indicator lights can also be wired into the auxiliary housing to let operators know whether the system power in on or off. Another use for the auxiliary housing is to mount an electromagnet in one housing and magnetic target in another housing to provide a physical latching/locking of two connectors together.

DETAILED DESCRIPTION

Figure 1:
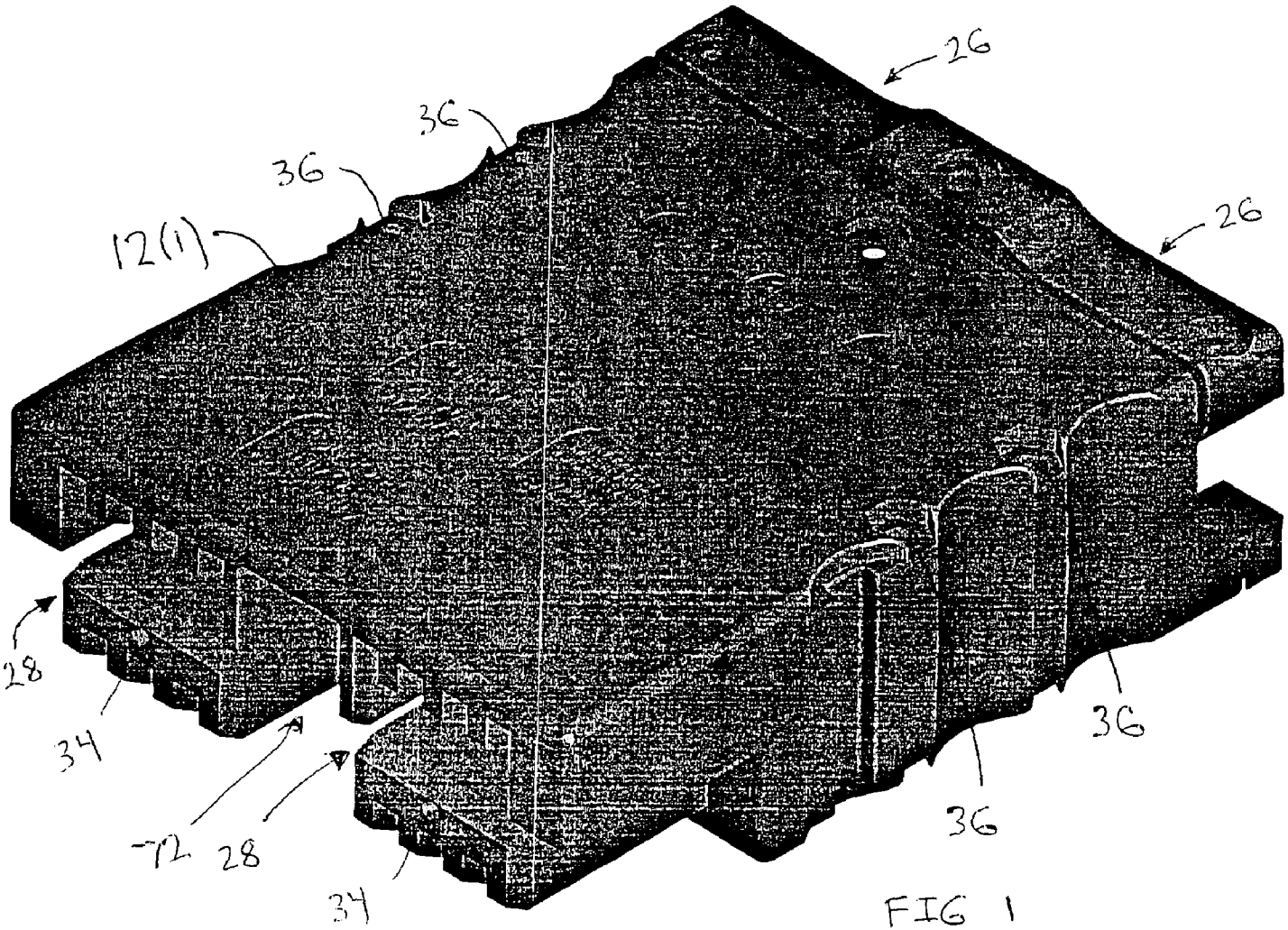
FIG. 1 is a perspective view of an electrical connector in accordance with one embodiment of the present invention.

An electrical connection system 10 in accordance with an embodiment of the present invention is illustrated in FIGS. 1–4. The electrical connection system includes a first housing 12(1), a second housing 12(2), first cable contacts 14, second cable contacts 16, grooves 18, a first retaining spring 20, a second retaining spring 22, and a lever system 24, although the electrical connection system 10 can comprise other numbers and types of components which are connected together in other manners. The present invention provides an electrical connection system 10 that is as easy to assemble and disassemble as prior electrical connection systems and is easy to connect and disconnect during fast or opportunity charging, and high amperage power connections.

Referring to FIGS. 1, 2, 4, and 6, the first and second housings 12(1) and 12(2) are illustrated. The first housing 12(1) defines a pair of passages 26 and another pair of passages 28, although the first housing 12(1) could have other numbers of passages in other arrangements. Each of the passages 26 for the first cable contacts 14 are in communication through an opening 27 with one of the passages 28 for detachably mating with the second cable contacts 16 in the second housing 12(2). The second housing 12(2) defines a pair of passages 30 and another pair of passages 32, although the second housing 12(2) also could have other numbers of passages in other arrangements. Each of the passages 30 for the second cable contacts 16 are in communication through an opening 31 with one of the passages 32 for detachably mating with the first cable contacts 14 in the first housing 12(1).

The section of the first housing 12(1) with the passages 28 is sized and shaped to mate with the section of the second housing 12(2) with the passages 32. In this particular embodiment, the mating sections of housings 12(1) and 12(2) have a genderless configuration, although these sections could have other configurations, such as a male/female configuration.

Each of the housings 12(1) and 12(2) also has opening or holes 34 which each extend into and are each in communication with one of the passages 26 in the housing 12(1) or one of the passages 30 in housing 12(2). The openings 34 are used in releasing the first and second cable contacts 14 and 16 in the housings 12(1) and 12(2) adjacent the opening at each interface end of the passages.

Four mounting holes 36 are formed in each of the housings 12(1) and 12(2) to receive screws for securing the housings 12(1) and 12(2) to a surface, although the housings 12(1) and 12(2) can have other numbers of mounting holes and can be secured to the surface in other manners. The four mounting holes 36 are also used to mount the lever system 24. The housings 12(1) and 12(2) are molded from plastic, although other types of appropriate engineering materials could be used to make housings 12(1) and 12(2).

Each of the cable contacts 14 and 16 has one end 38 which is crimped around a pair of cables 40 which together can carry about 700 amps, although each of the cable contacts 14 and 16 could be coupled to other numbers of cables and could handle other amounts of current. An opposing end 42 of each of the cable contacts 14 and 16 has a mating surface 44 with a ridge 46 and a retaining surface 48 on an opposing side, although the opposing end of each of the cable contacts 14 and 16 could have other shapes and sizes.

Each of the cable contacts 14 detachably mates in one of the passages 26 in the first housing 12(1) with the opposing end 42 of each cable contact 14 extending through the opening 27 into one of the passages 28, although other configurations for mating cable contacts 14 in passages 26 could be used. Each of the cable contacts 16 also detachably mates in one of the passages 30 in the second housing 12(2) with the opposing end 42 of each cable contact 16 extending through the opening 31 into one of the passages 32, although other configurations for mating cable contacts 16 in passages 28 could be used.

Figure 2:
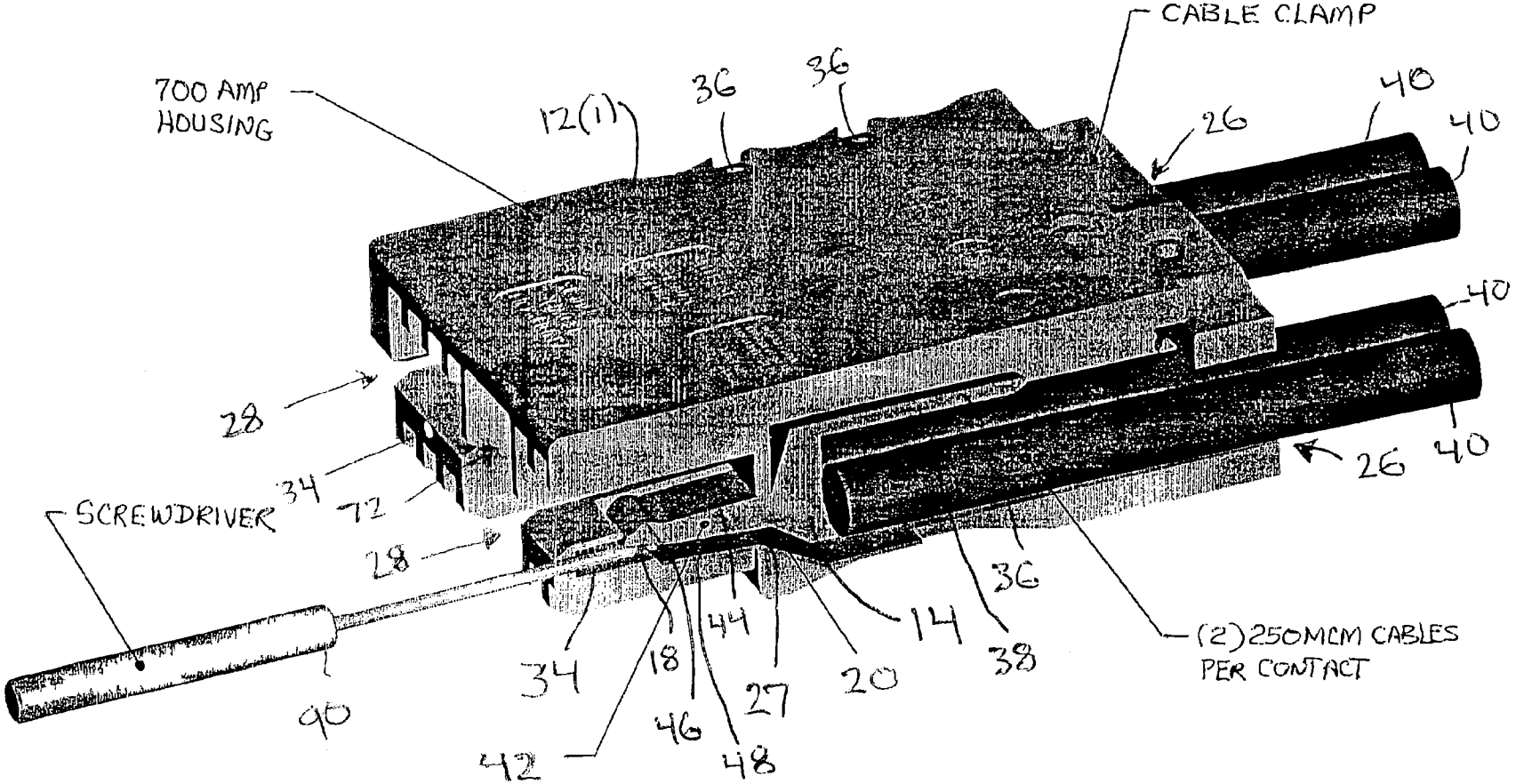
FIG. 2 is a broken away, perspective view of the connector shown in FIG. 1 with cable contact installed in the connector just prior to being released.
Figure 3:
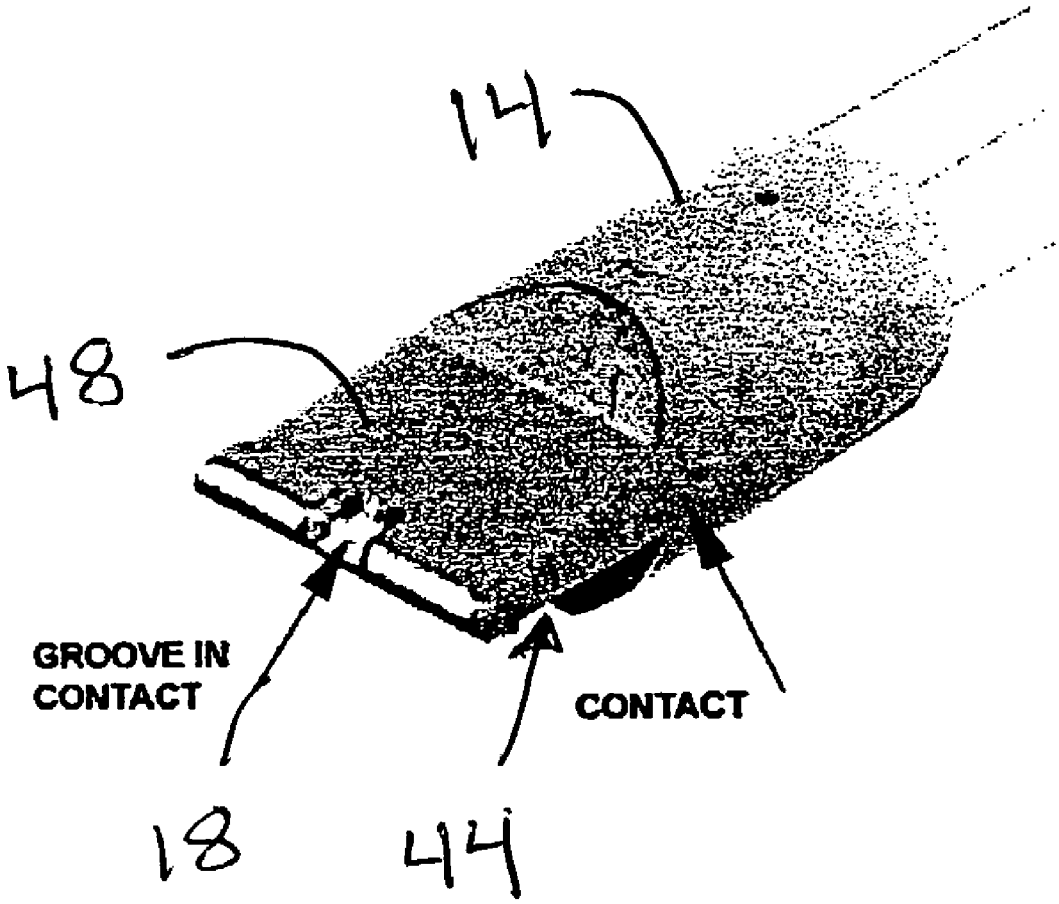
FIG. 3 is a perspective view of a spring release groove in the cable contact.

Referring to FIGS. 2 and 3, a groove 18 is formed in the retaining surface 48 in each of the cable contacts 14 and 16, although the groove 18 can be located on other parts. The groove 18 is used to release the opposing end 42 of each of the cable contacts 14 and 16 (by inserting and twisting a thin blade, such as a screwdriver 90, between the cable contact 14 and 16 and the corresponding retaining springs 20 and 22), so the cable contacts 14 and 16 can be easily withdrawn from passages 26 and 30. The groove 18 in the retaining surface 48 of each of the cable contacts 14 is in substantial alignment and fluid communication with one of the openings 34 in housing 12(1). The groove 18 in the retaining surface 48 of each of the cable contacts 16 is in substantial alignment and fluid communication with one of the openings 34 in housing 12(2).

Figure 4:
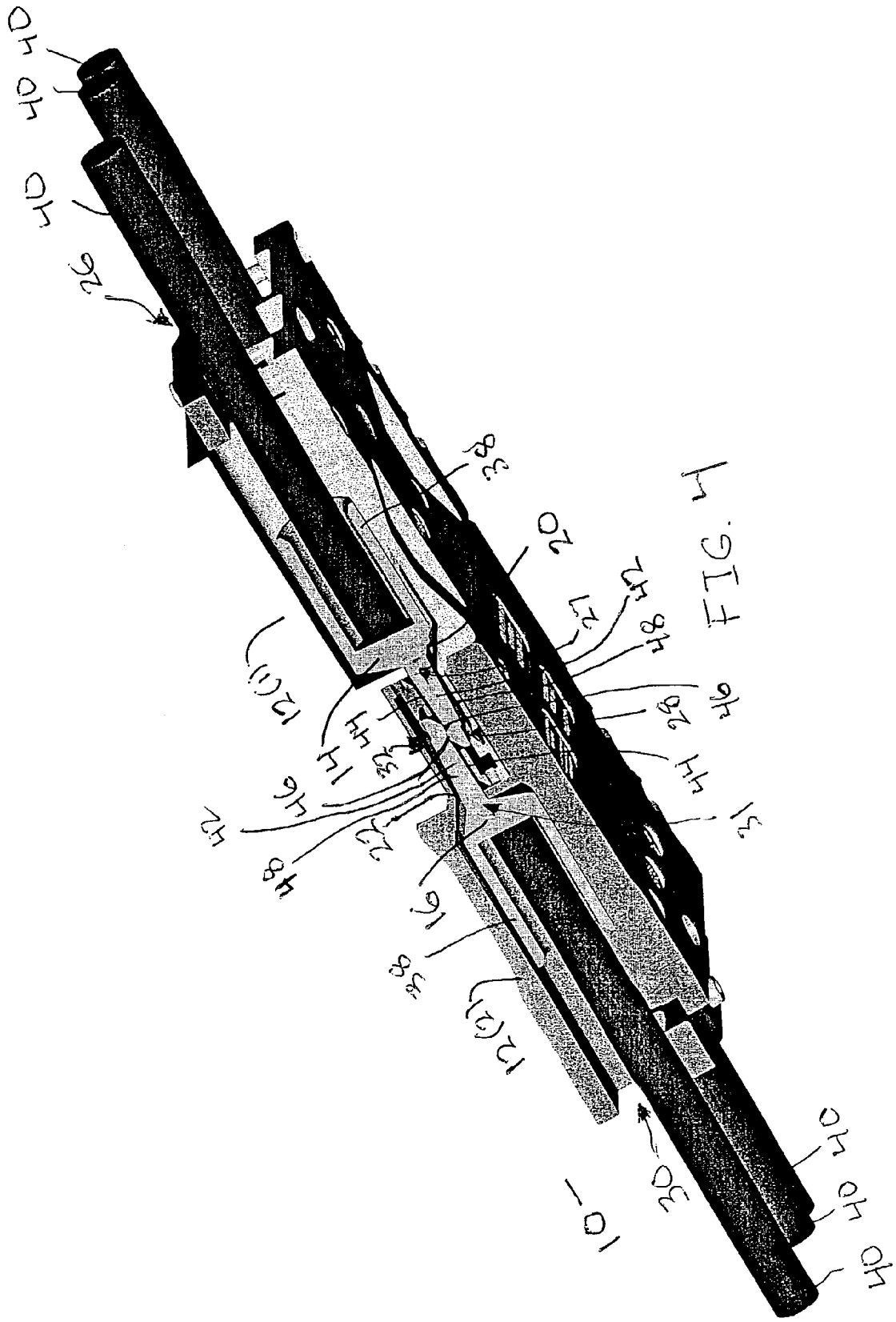
FIG. 4 is a cross-sectional view of a pair of the electrical connectors coupled together.

Referring to FIGS. 2 and 4, each of the first retaining springs 20 is secured in one of the passages 26 in the first housing 12(1) and extends through the opening 27 into one of the passages 28, although other types of retaining devices can be used and the spring or other retaining device can be secured to the housing 12(1) in other manners. Each of the first retaining springs 20 is biased against one of the retaining surfaces 48 for one of the cable contacts 14 which is biased against an inner surface of the housing 12(1) in the opening 27 to detachably retain each of the cable contacts 14 in the passages 26.

Each of the second retaining springs 22 is secured in one of the passages 30 in the second housing 12(2) and extends through the opening 31 into one of the passages 32, although other types of retaining devices can be used and the spring or other retaining device can be secured to the housing 12(2) in other manners. Each of the second retaining springs 22 is biased against one of the retaining surfaces 48 for one of the cable contacts 16 which is biased against an inner surface of the housing 12(2) in the opening 31 to detachably retain each of the cable contacts 16 in the passages 30.

The width of each of the first and second retaining springs 20 and 22 do not need to be greater than the width of the corresponding cable contact 14 and 16 because the grooves 18 can be used to release each of the cable contacts 14 and 16. As a result, the overall size of the passages 26 and 30 and of the overall housings 12(1) and 12(2) can be reduced, or the size of the cable contacts 14 and 16 can be increased to carry higher currents.

Figure 5A:
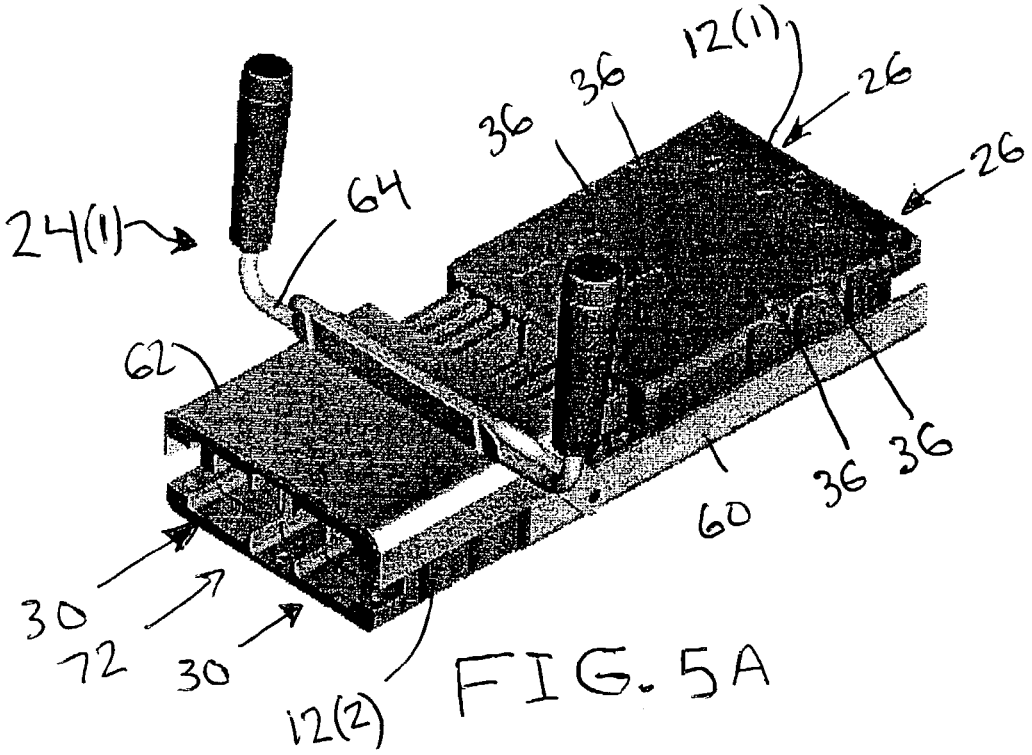
FIG. 5A is a perspective view of a pair of electrical connectors, with a handle/latching system in accordance with one embodiment of the present invention, in an open state.
Figure 5B:
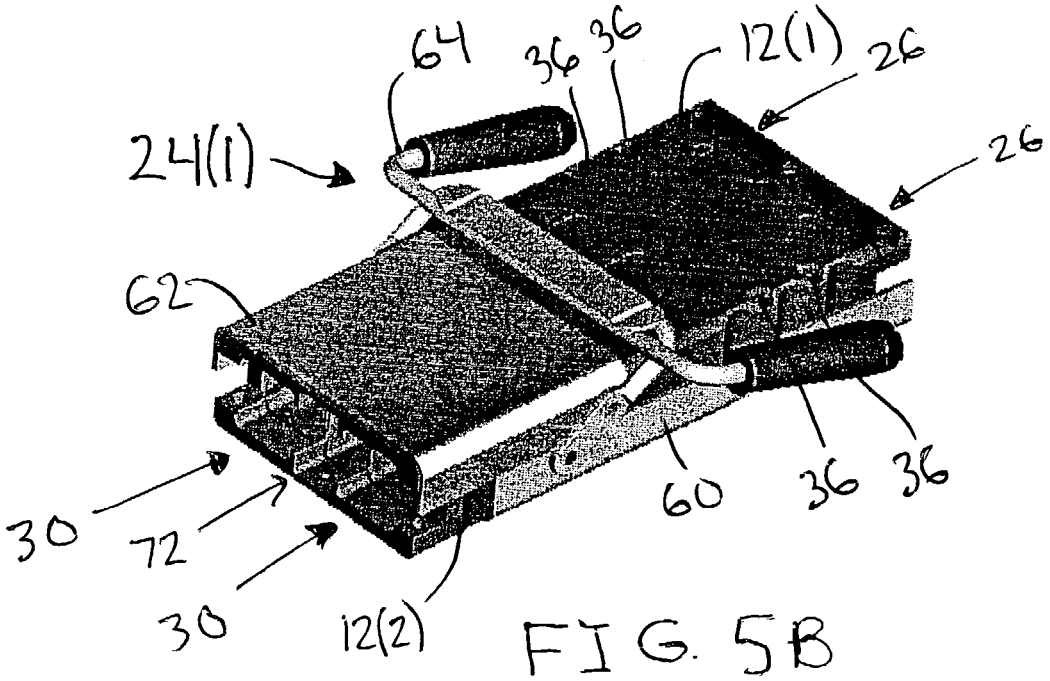
FIG. 5B is a perspective view of the pair of electrical connectors shown in FIG. 5A, in a closed state.

Referring to FIGS. 5A and 5B, a U-shaped plate 60 is bolted to one of the housings 12(1) and another U-shaped plate 62 is bolted to the other one of the housings 12(2), although other types and shapes of plates could be used. A U-shaped handle 64 is pivotally connected to the first and second housings 12(1) and 12(2) to detachably connect or disconnect the first and second cable contacts 14 and 16 and first and second housings 12(1) and 12(2), although other types and shapes of handles could be used. Although one type of lever system 24(1) for connecting and disconnecting the first and second cable contacts 14 and 16 and first and second housings 12(1) and 12(2) is shown in FIGS. 5A and 5B, other types of lever systems can be used.

Figures 5C, 5D:
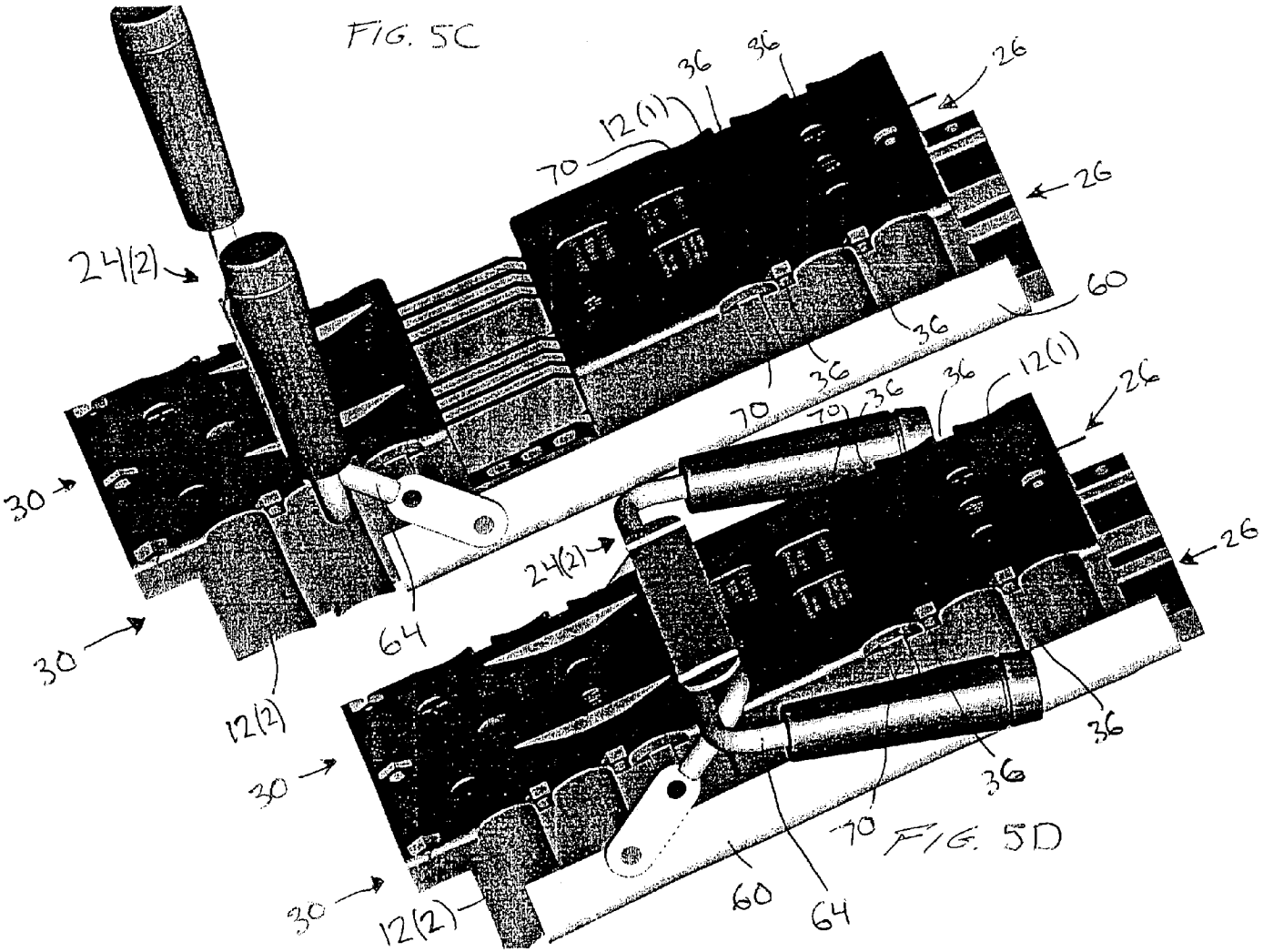
FIG. 5C is a perspective view of a pair of electrical connectors, with a handle/latching system in accordance with another embodiment of the present invention, in an open state.
FIG. 5D is a perspective view of the pair of electrical connectors shown in FIG. 5C, in a closed state.

Referring to FIGS. 5C and 5D, an alternative lever system 24(2) for connecting and disconnecting the first and second cable contacts 14 and 16 and first and second housings 12(1) and 12(2) is illustrated. A U-shaped plate 60 is bolted to one of the housings 12(1), although other types and shapes of plates could be used. Elongated slots 70 are formed on opposing sides of the housing 12(2), although other numbers and shapes of grooves could be used. A U-shaped handle 64 is pivotally connected to the first housing 12(1) and also has projections which each ride in one of the elongated slots 70 on housing 12(2), although other types and shapes of handles could be used. The handle 64 is used to detachably connect or disconnect the first and second cable contacts 14 and 16 and first and second housings 12(1) and 12(2).

Referring to FIGS. 1, 2, 7, and 8, each of the housings 12(1) and 12(2) includes a passage 72 in which a battery monitoring system 80 is mounted, although the passage 72 could hold other numbers and types of auxiliary devices. The battery monitoring system 80 is coupled to the cables 40 and captures information about the status of the battery being charged during fast or rapid battery charging, such as maximum and minimum voltages, temperatures and charging currents. In this particular embodiment, the battery monitoring system 80 includes a central processing unit (CPU) or processor, a memory, and a transceiver system which are coupled together by a bus system or other link, respectively, although the battery monitoring system 80 may comprise other components, other numbers of the components, and other combinations of the components and may transfer data to another computer system for further processing.

The processor in the battery monitoring system 80 executes one or more programs of stored instructions for monitoring and charging of a battery in accordance with one embodiment of the present invention as described herein; although the system 80 could be programmed with instructions to carry out other operations. In this embodiment, the programmed instructions are stored in the memory, although some or all of those programmed instructions could be stored and retrieved from one or more memories at other locations. A variety of different types of memory storage devices, such as a random access memory (RAM) or a read only memory (ROM) in the system or a floppy disk, hard disk, CD ROM, or other computer readable medium which is read from and/or written to by a magnetic, optical, or other reading and/or writing system that is coupled to the processor, can be used for memory. The transceiver system is used to operatively couple and communicate between the battery monitoring system 80 and other systems. In this particular embodiment, an infrared (IR) communications port 82 is used for transmitting the information to another computer system, although other types of connections and communication systems can be used. For example, wireless radio, IR, fiber optic or electrically wired communication systems for data transmission, remote control and/or monitoring could be used. Additionally, wired and wireless Internet and satellite communications could also be used.

Although a battery monitoring system 80 is shown other types of auxiliary devices could be used, such as electromagnetic interlock system mounted in the passage 72 of the housing 12(1) and 12(2). With the electro-magnetic interlock system, a metal slug is mounted in passage 72 in housing 12(1) and an electromagnet is mounted in the passage 72 in the housing 12(2). The housings 12(1) and 12(2) can be locked together or released with the electromagnetic interlock system.

The method of making an electrical connection will be described with reference to FIGS. 1–4. Cables 40 are crimped or other wise secured to one end 38 of cable contacts 14. Next, the cable contacts 14 which are coupled to cables 40 are each inserted in to one of the passages 26 so that the opposing end 42 of each cable contact 14 passes through one of the openings 27 to one of the passages 28 in housing 12(1). As the opposing end 42 of each of the cable contacts 14 passes through one of the openings 27, one of the first retaining springs 20 detachably engages with the retaining surface 48 of one of the cable contacts 14. This causes the mating surface 44 of each of the cable contacts 14 to be biased against an inner surface of the housing 12(1) in the opening 27 to detachably retain each of the cable contacts 14 in the passages 26.

Similarly, cables 40 are crimped or other wise secured to one end 38 of cable contacts 16. Next, the cable contacts 16 which are coupled to cables 40 are each inserted in to one of the passages 30 so that the opposing end 42 of each cable contact 16 passes through one of the openings 31 to one of the passages 32 in housing 12(2). As the opposing end 42 of each of the cable contacts 16 passes through one of the openings 31, one of the second retaining springs 22 detachably engages with the retaining surface 48 of one of the cable contacts 16. This causes the mating surface 44 of each of the cable contacts 16 to be biased against an inner surface of the housing 12(2) in the opening 31 to detachably retain each of the cable contacts 16 in the passages 30.

To remove each of the cable contacts 14 from the passages 26, a screwdriver 90 or other narrow device or object is inserted into one of the holes 34 which is in communication with one of the grooves 18 in the retaining surface 48 of each of the cable contacts 14 in one of the passages 28. An end of the screwdriver 90 is wedged between the groove 18 in the retaining surface 48 of the cable contact 14 and the retaining spring 20. Twisting the screwdriver 90, pushes the first retaining spring 20 away to release the cable contact 14, allowing the cable contact 14 to be easily retracted from the passages 26 and 28 in the housing 12(1).

Similarly, to remove each of the cable contacts 16 from the passages 30, a screwdriver 90 or other narrow device or object is inserted into one of the holes 34 which is in communication with one of the grooves 18 in the retaining surface 48 of each of the cable contacts 16 in one of the passages 32. An end of the screwdriver 90 is wedged between the groove 18 in the retaining surface 48 of the cable contact 16 and the retaining spring 20. Twisting the screwdriver 90, pushes the second retaining spring 22 away to release the cable contact 16, allowing the cable contact 16 to be easily retracted from the passages 30 and 32 in the housing 12(2)

To electrically couple the cable contacts 14 with the cable contacts 16, the section of the housings 12(1) with passages 28 needs to be detachably mated together with the section of the housing 12(2) with passages 30. As these sections of the housing 12(1) and 12(2) are brought together, each of the ridges 46 on each of the mating surfaces 44 for each of the cable contacts 14 engages with and rides over a corresponding one of the ridges 46 on one of the mating surfaces 44 for one of the cable contacts 16. When these sections of the housing 12(1) and 12(2) are detachably mated together, the mating surface 44 of each of the cable contacts 14 rest against and are detachably coupled to one of the mating surfaces 44 of one of the cable contacts 16 to electrically couple the cables 40 crimped to each of the cable contacts 14 and 16 together.

Referring to FIGS. 5A-5D, the lever systems 24(1) and 24(2) can be used to detachably mate the sections of the housing 12(1) and 12(2) along with the cable contacts 14 and 16 together. More specifically, pivotal movement of the handle 64 towards the housing 12(1) causes the housing 12(2) to be moved towards and detachably mate with the housing 12(1) to detachably couple the cable contacts 14 and 16. Pivotal movement of the handle 64 away from the housing 12(1) causes the housing 12(2) to be moved away and disengage with the housing 12(1) to disconnect the cable contacts 14 and 16. The lever system 24(1) and 24(2) make the electrical connection system 10 easier to connect and disconnect.

Figure 6:
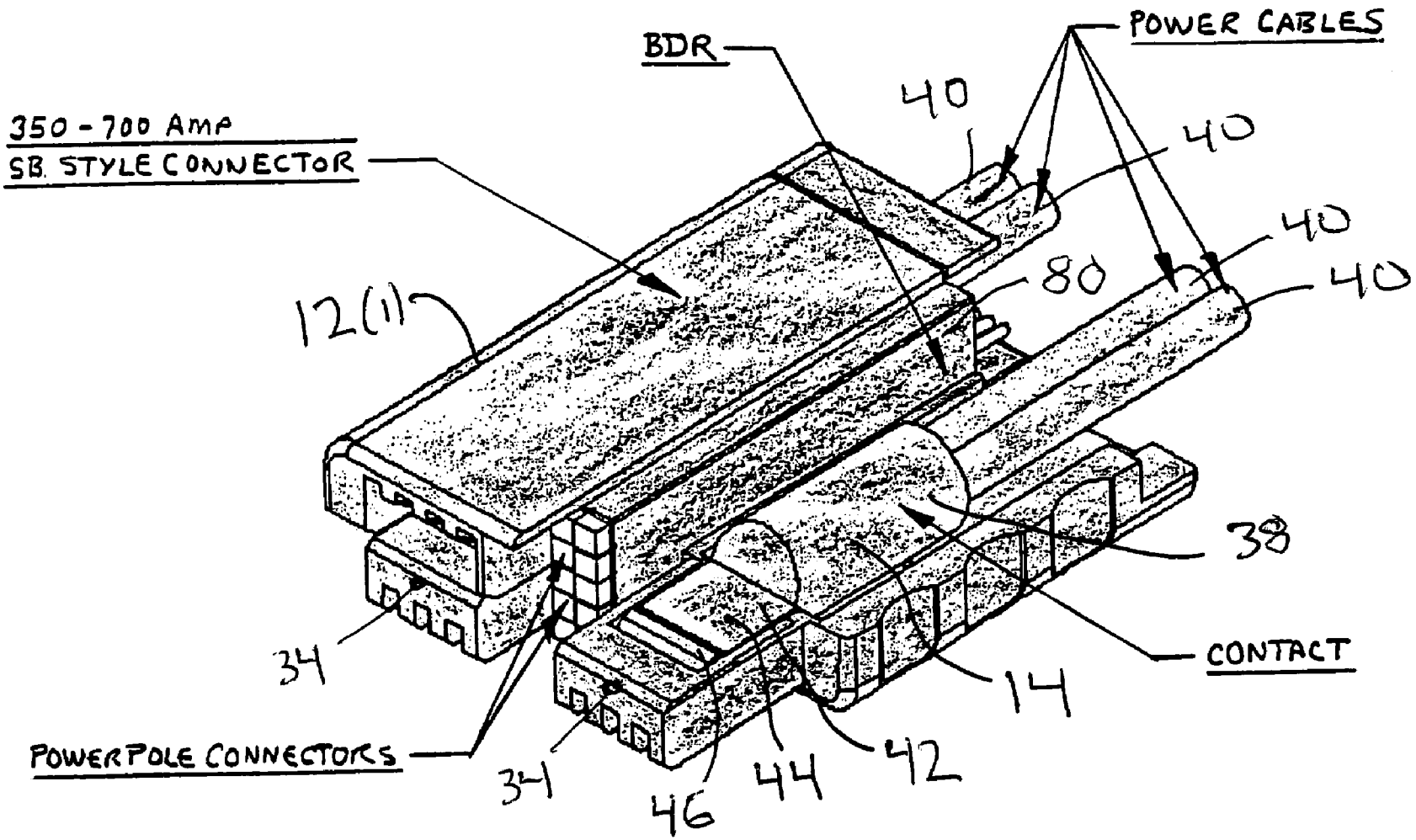
FIG. 6 is a broken away, perspective view of an electrical connector with a battery monitoring device in accordance with another embodiment of the present invention.
Figure 7:
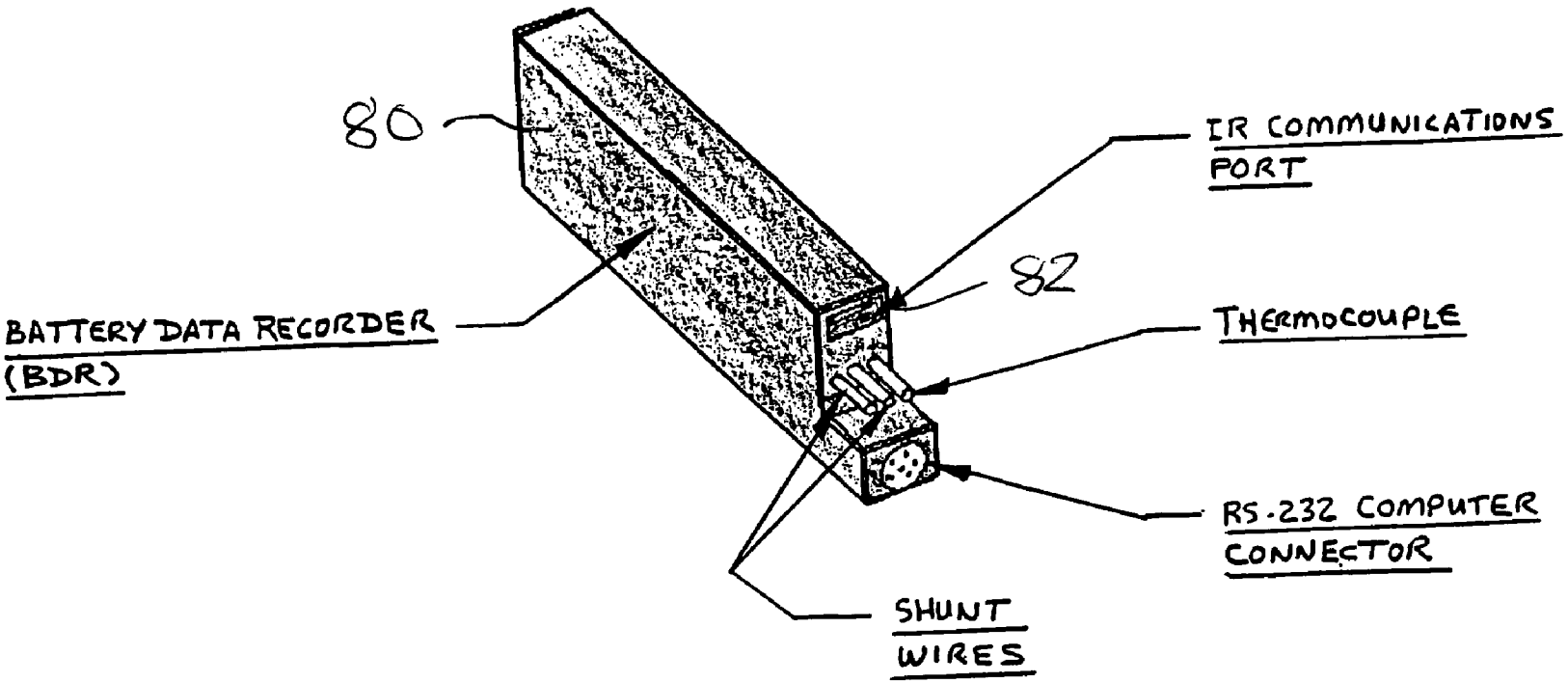
FIG. 7 is a perspective view of the battery monitoring device concept.
Figure 1:
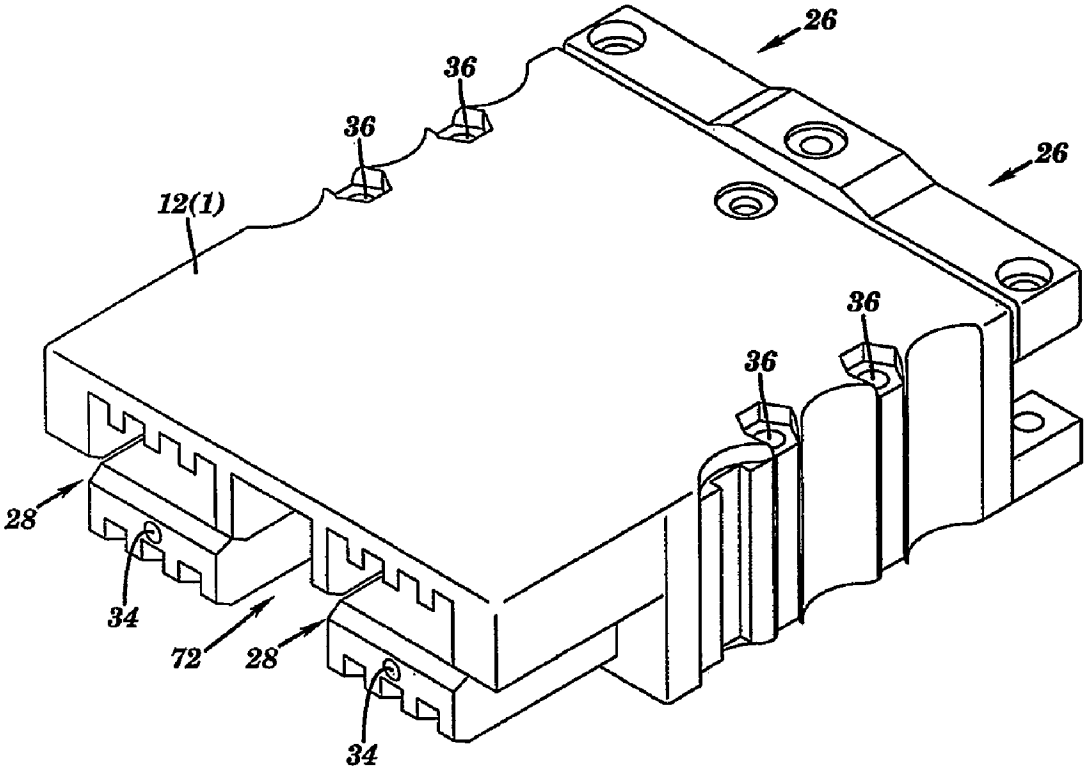
Figure 2:
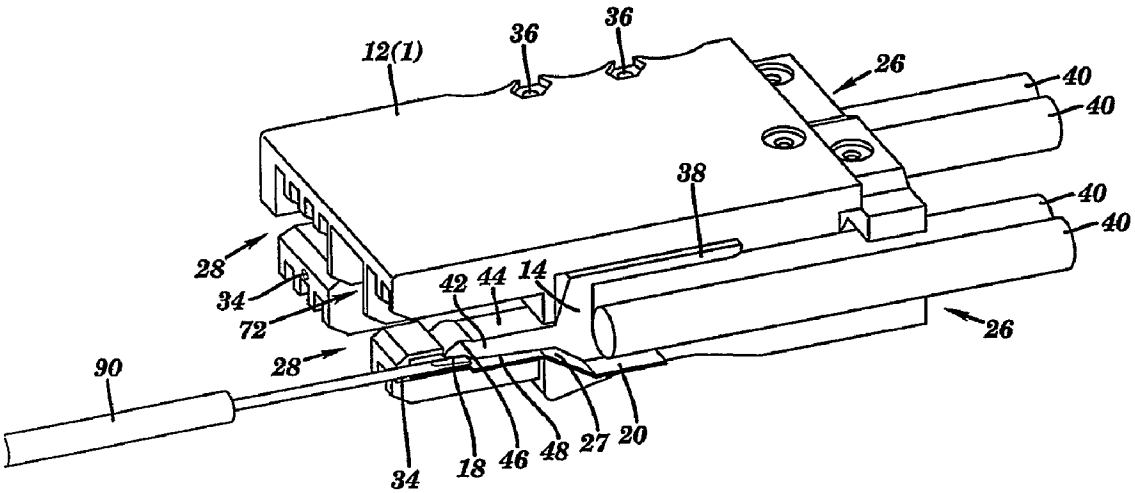
Figure 3:
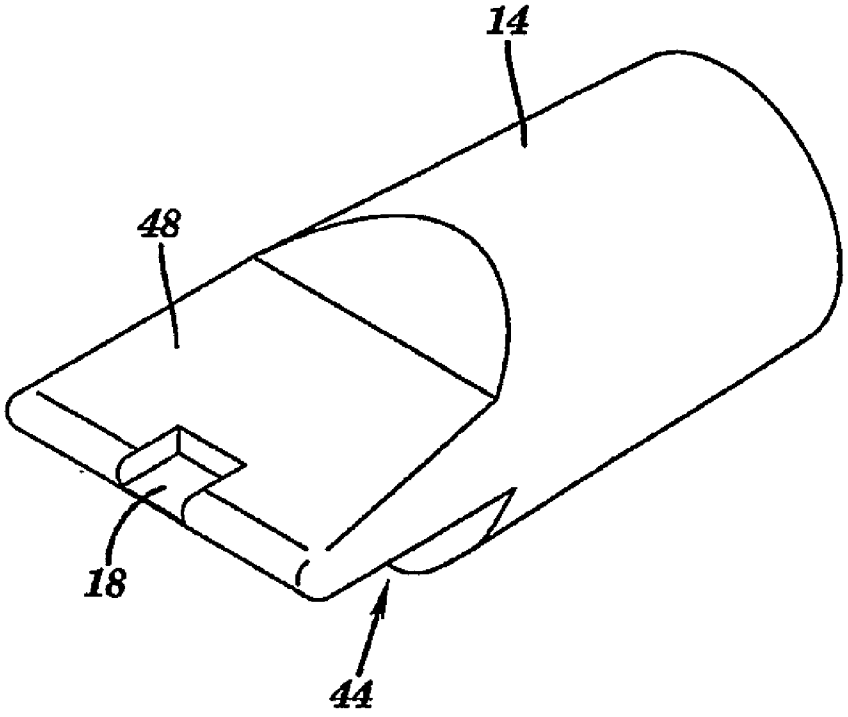
Figure 4:
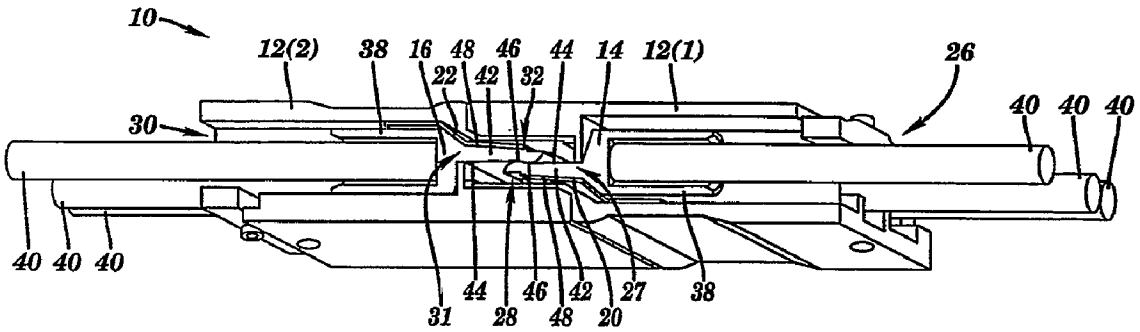
Figure 5A:
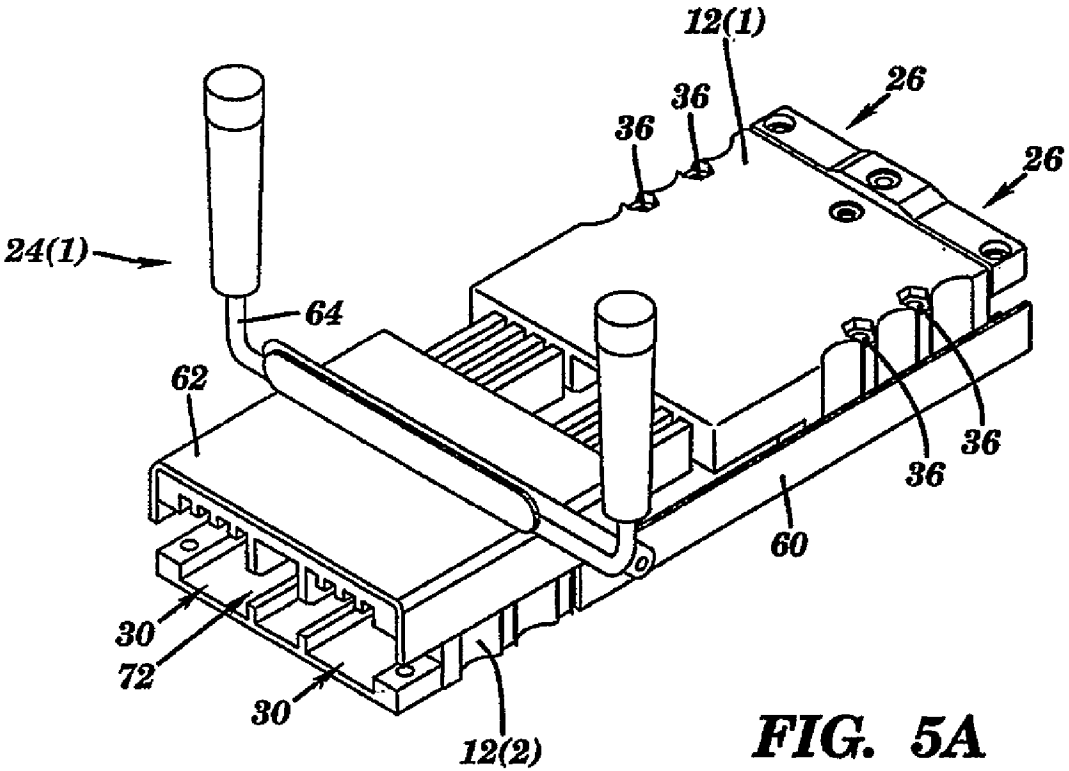
Figure 5B:
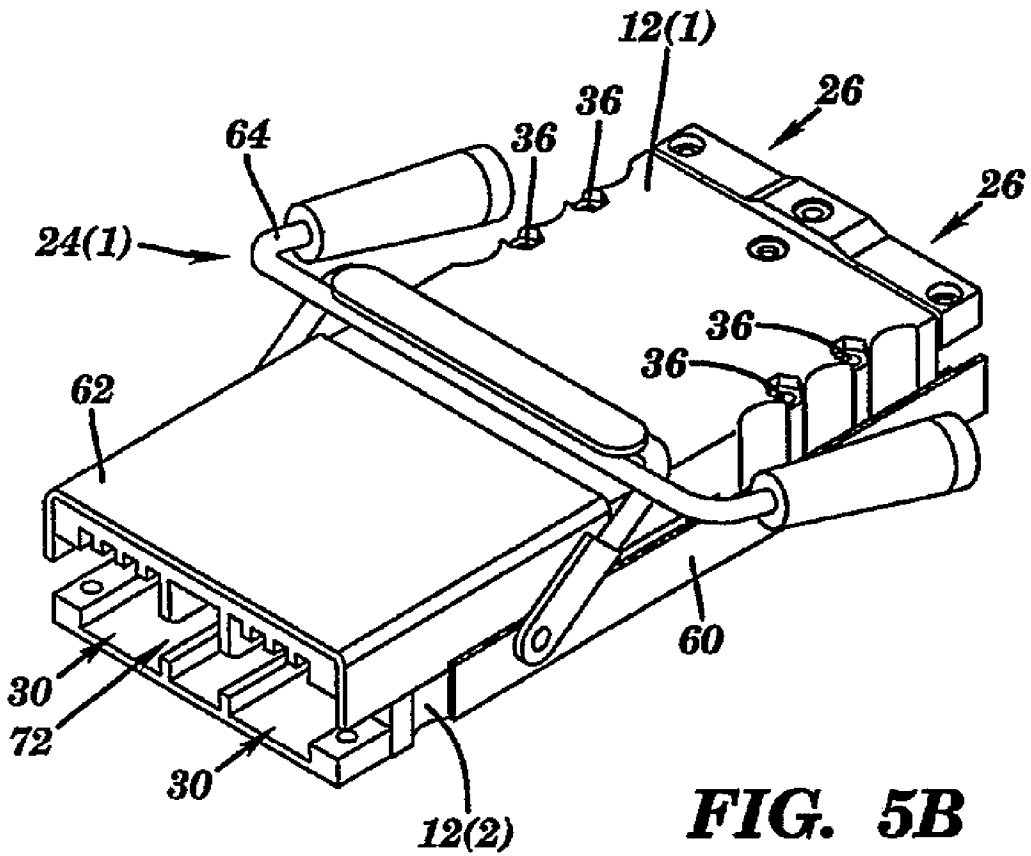
Figure 5C:
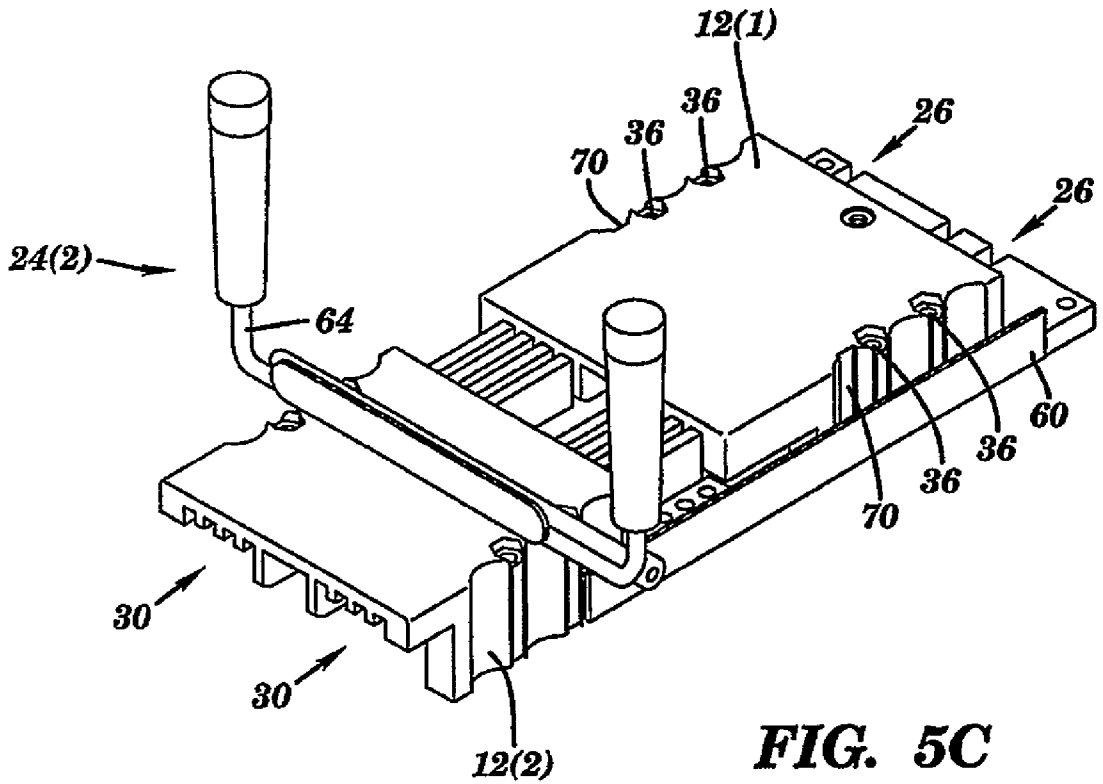
Figure 5D:
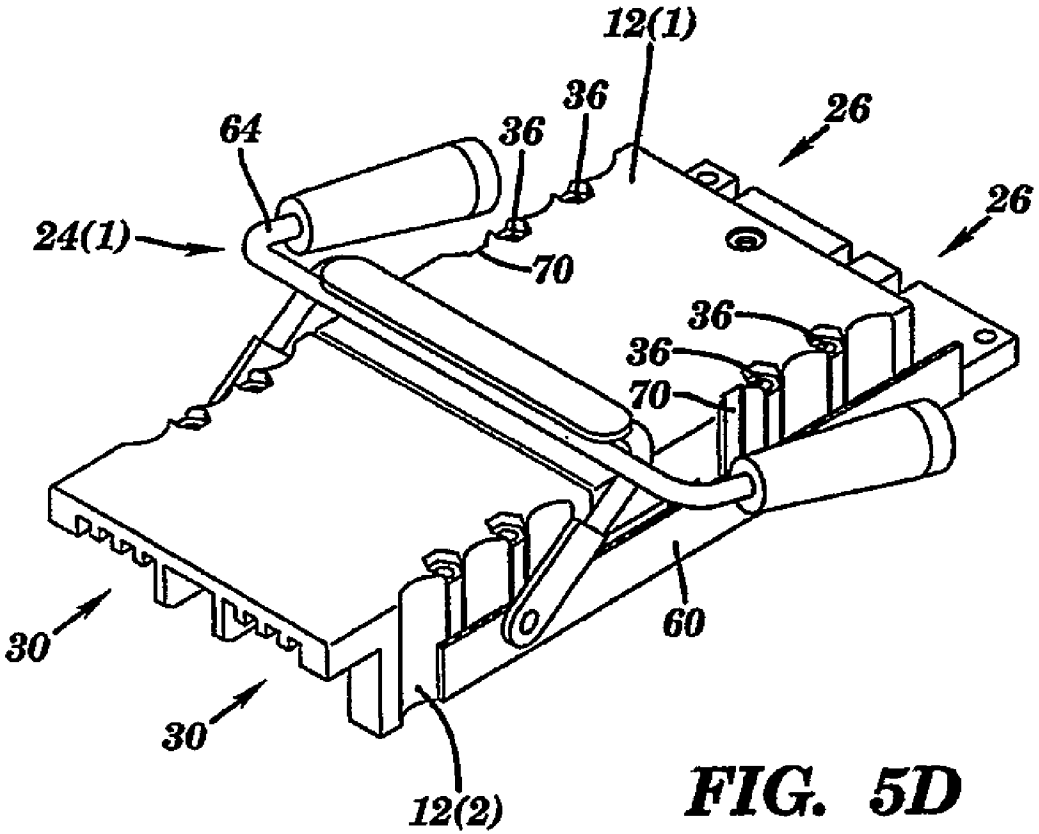
Figure 6:
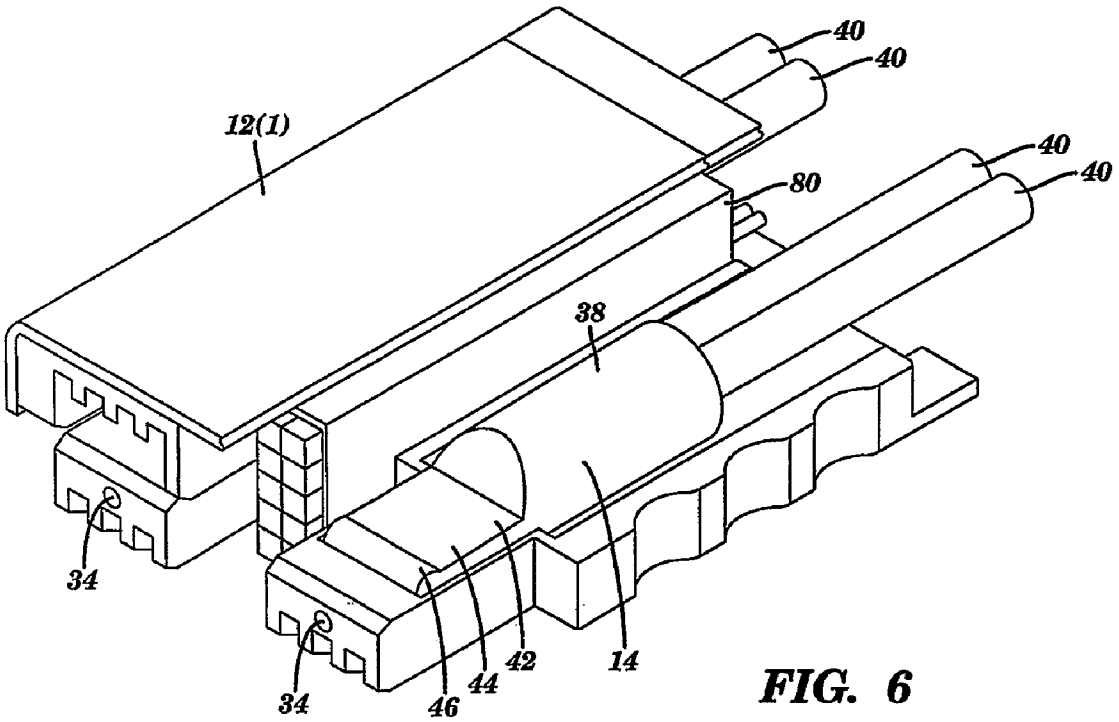
Figure 7:
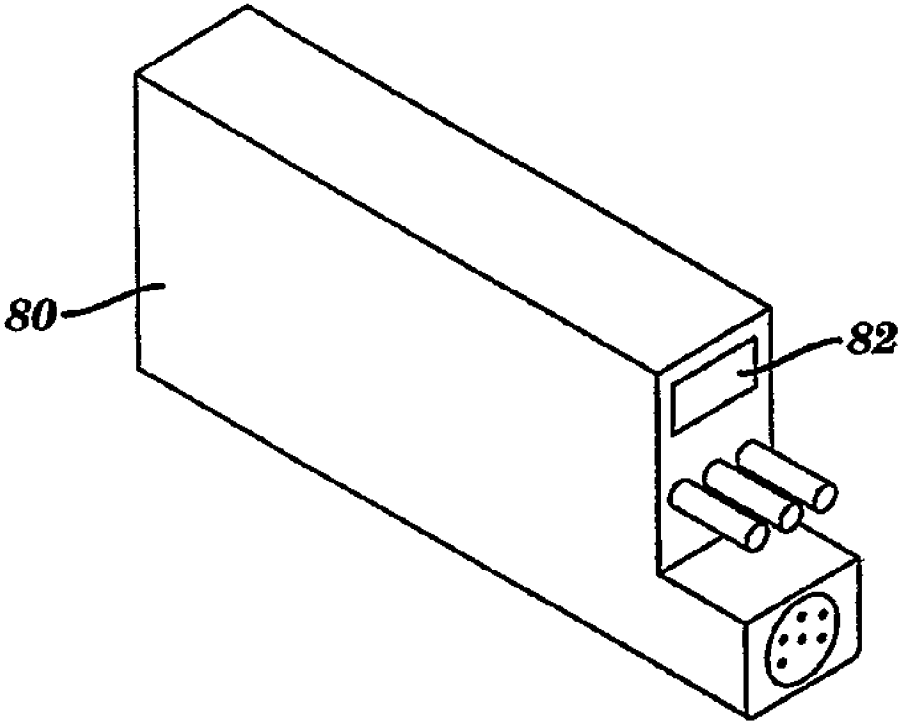
Figure 1:
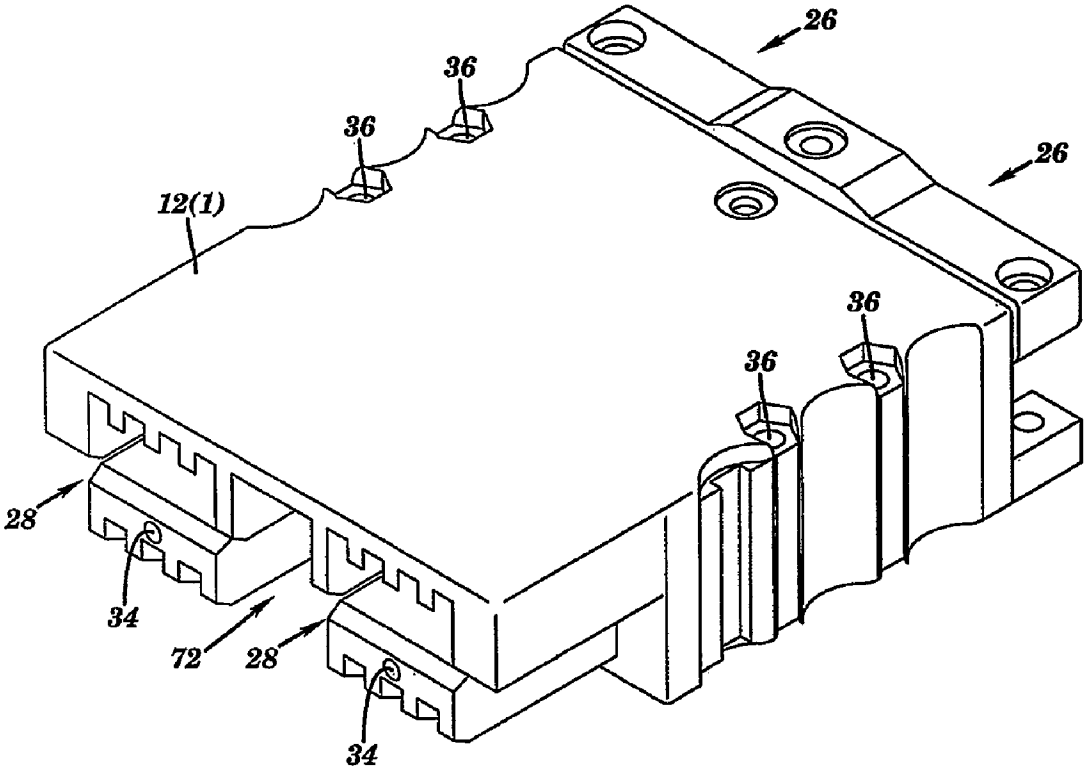
Figure 2:
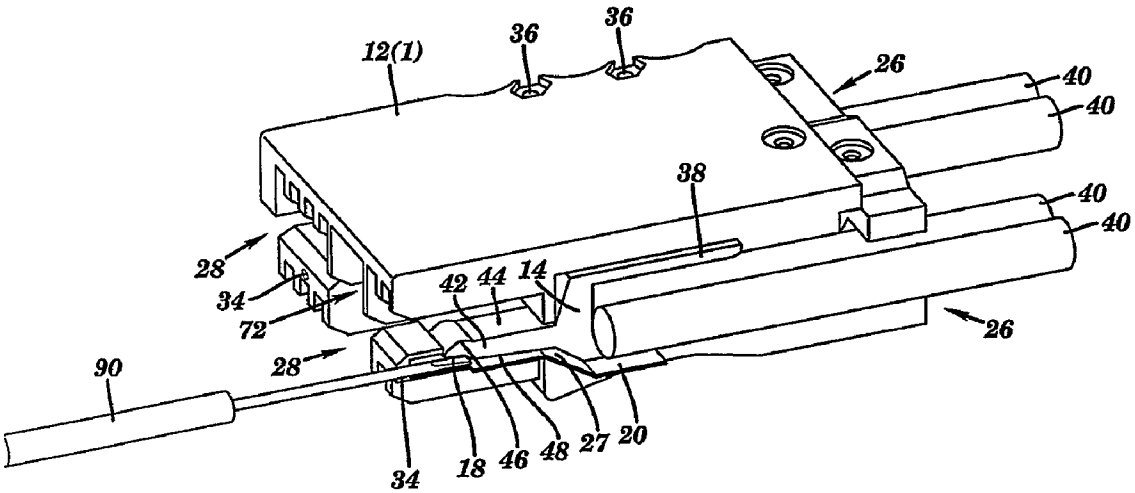
Figure 3:
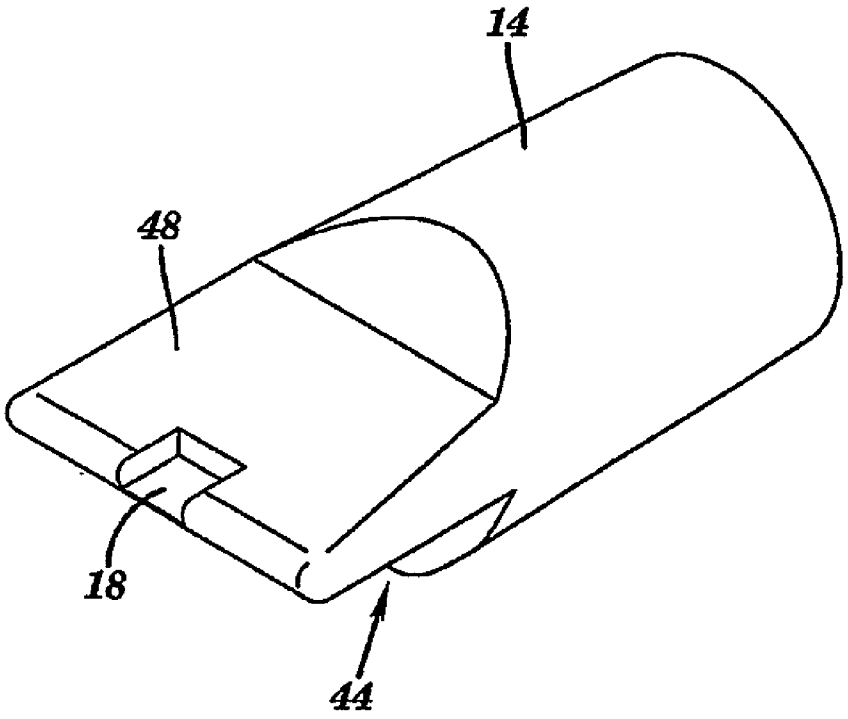
Figure 4:
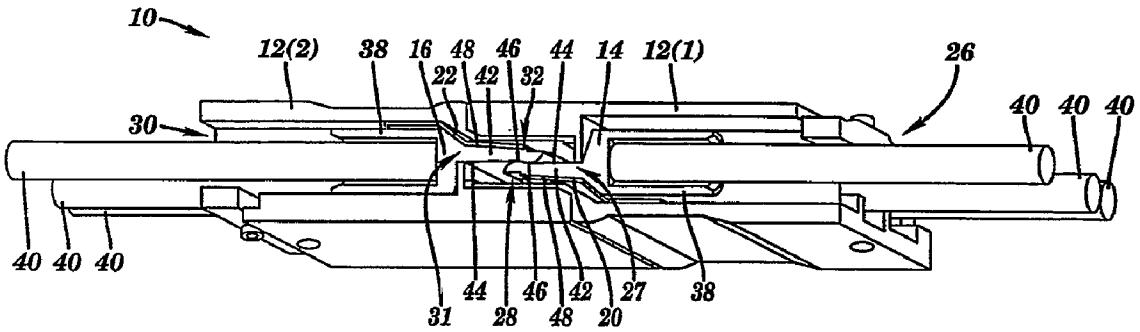
Figure 5A:
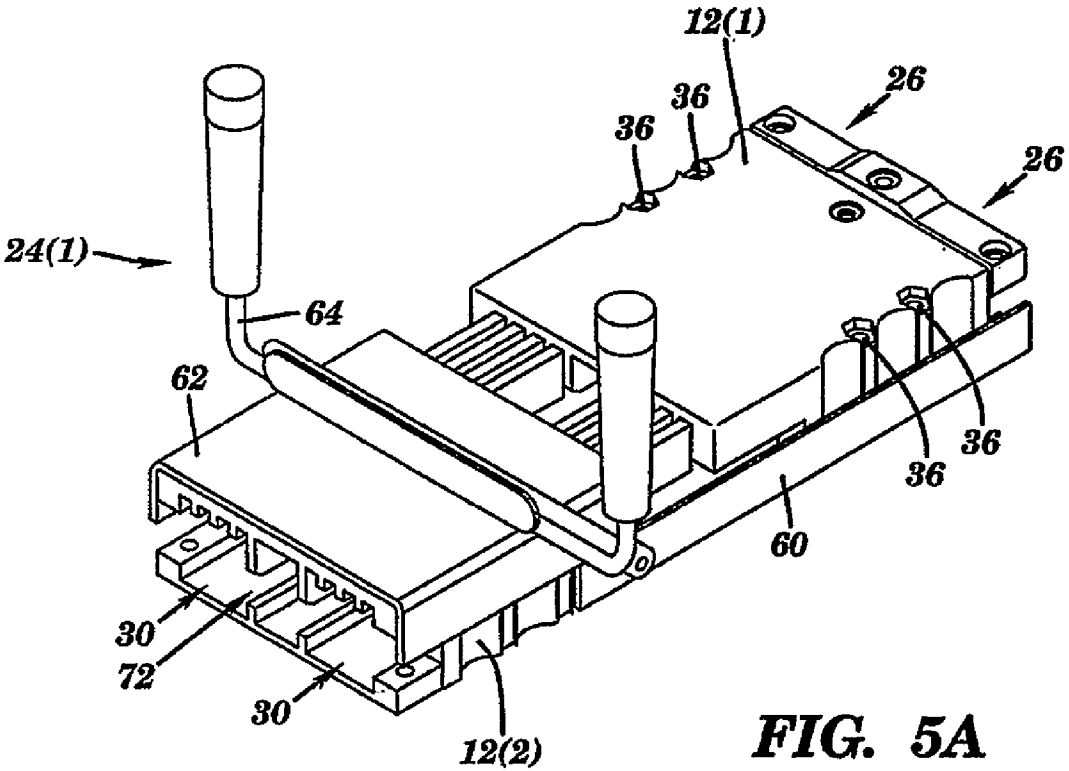
Figure 5B:
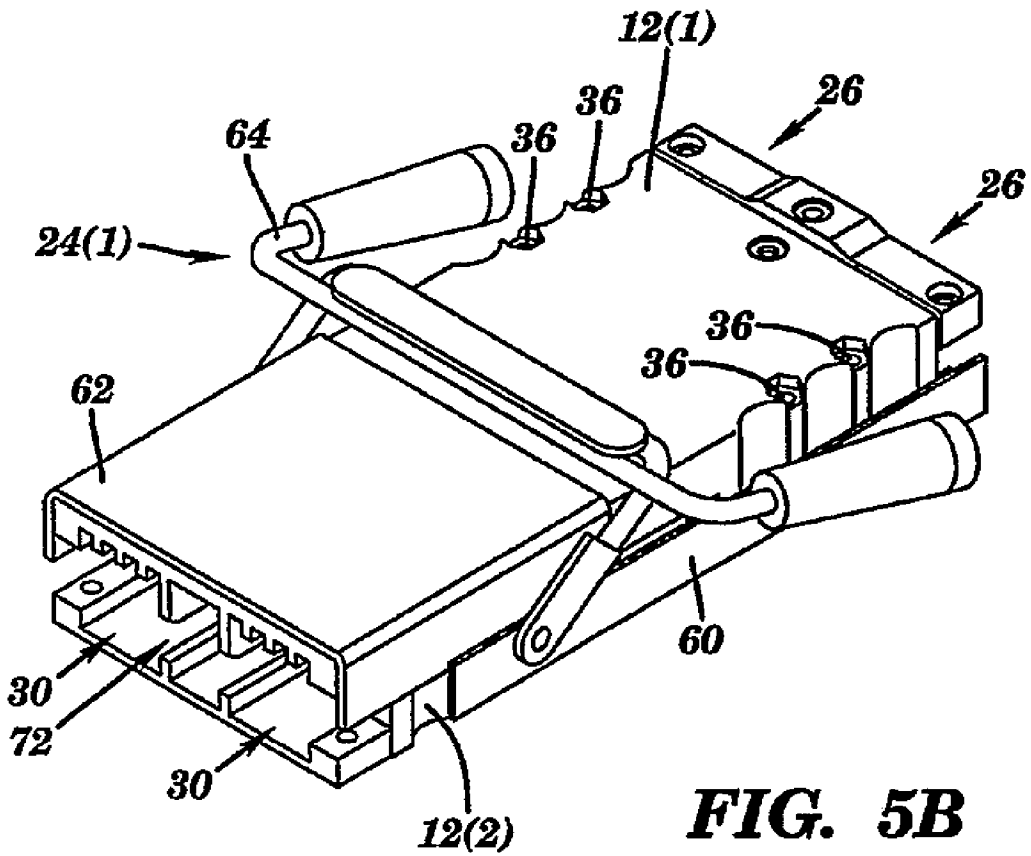
Figure 5C:
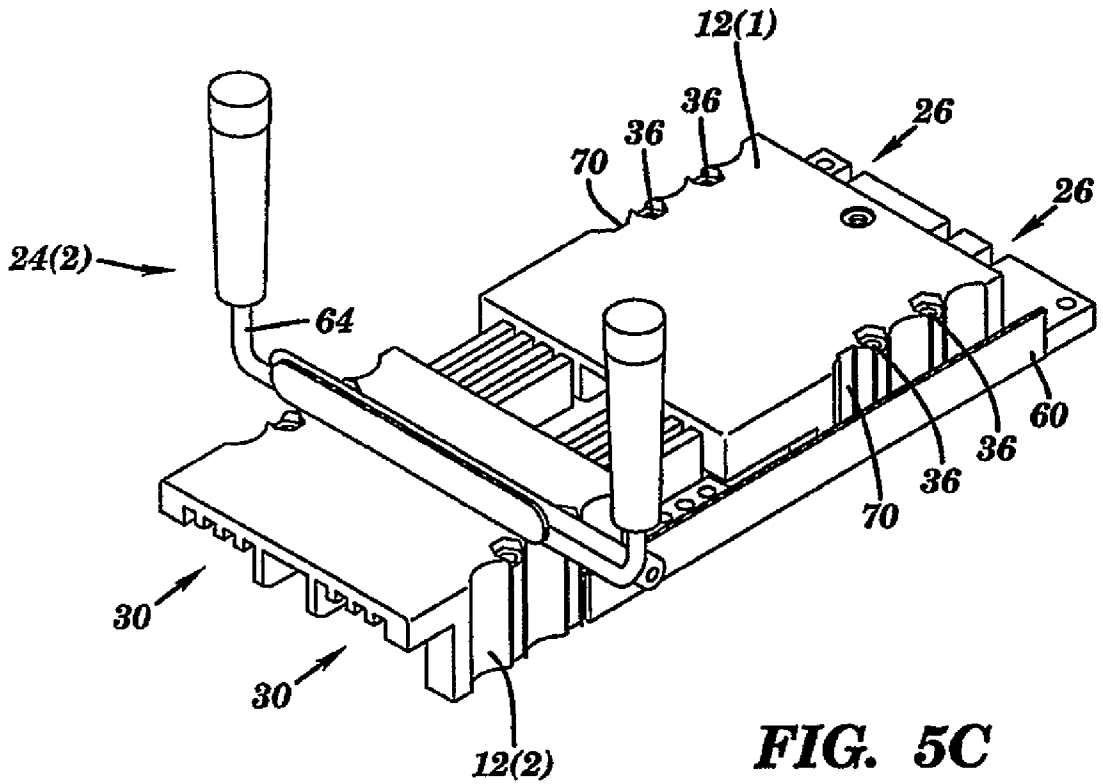
Figure 5D:
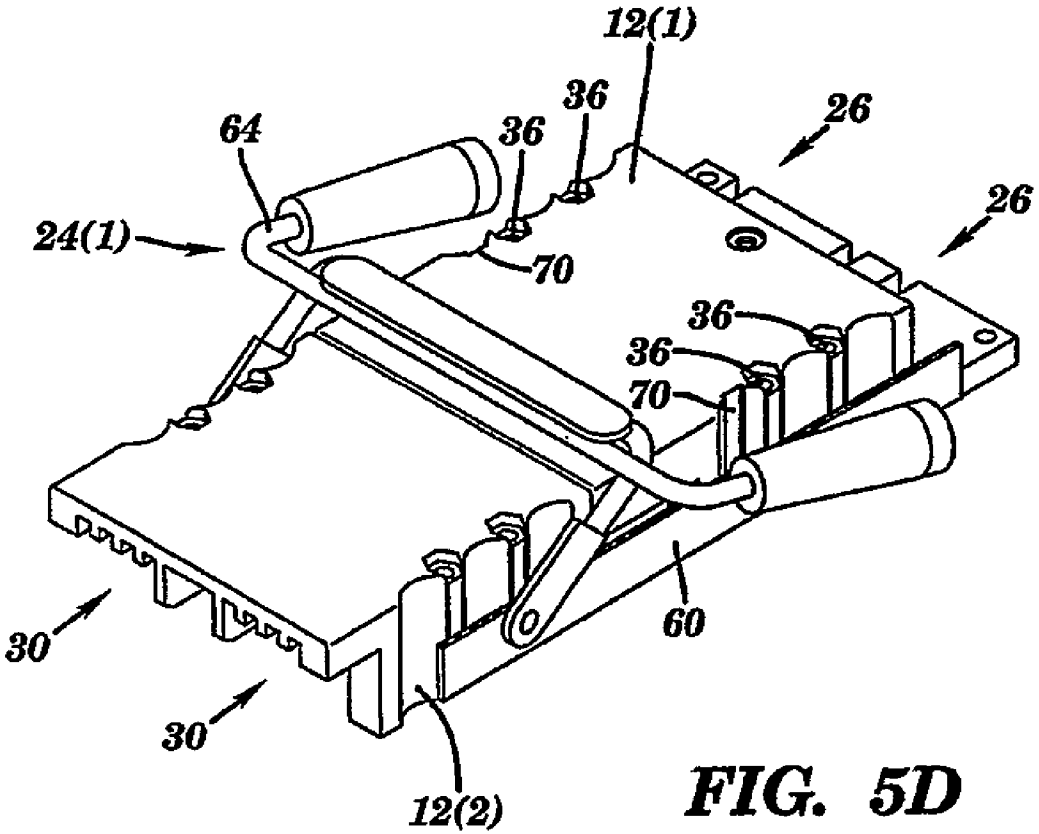
Figure 6:
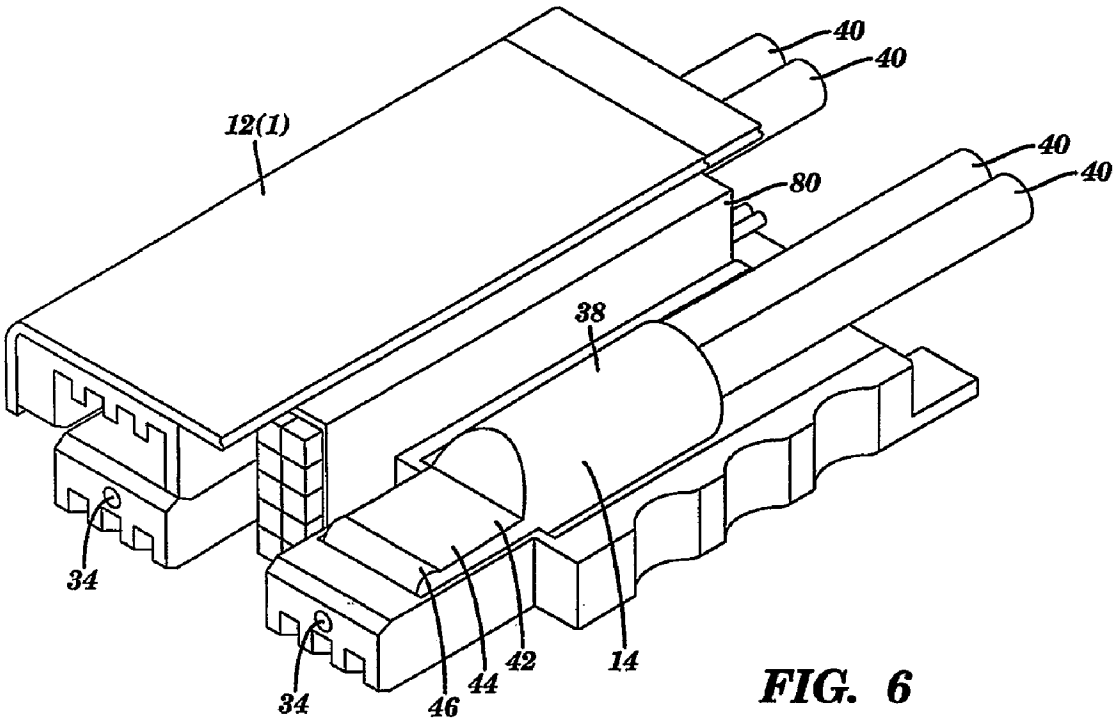
Figure 7:
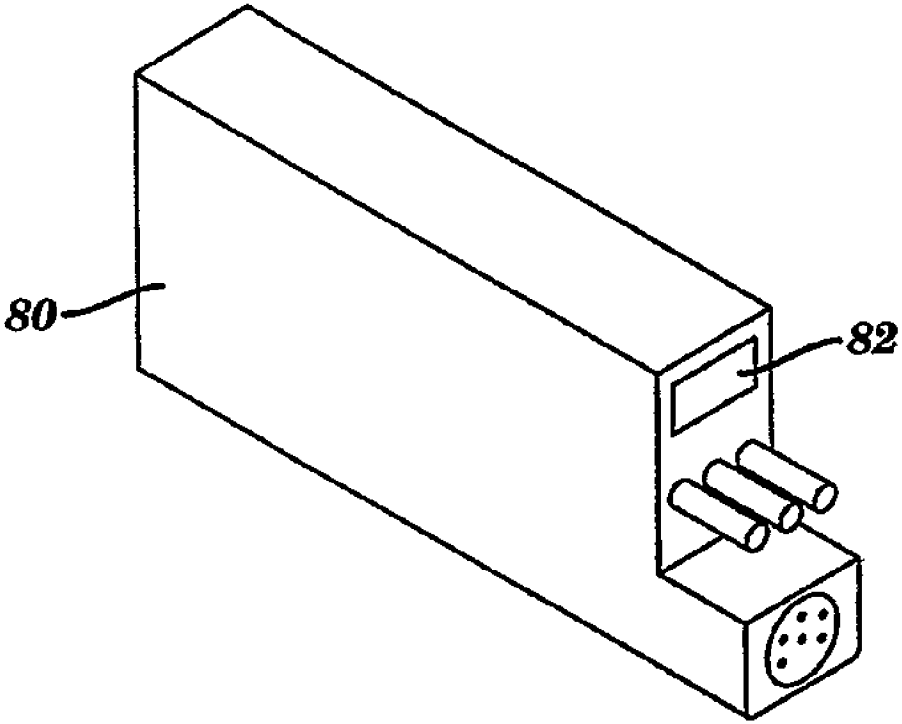

Referring to FIGS. 6 and 7, the battery monitoring device 80 monitors one or more functions through the cables 40, such as the status of the connection, the status of the battery being charged during fast or rapid battery charging, maximum and minimum voltages, temperatures and charging currents. The captured information can be processed by the monitoring device 80 and then output, such as providing an indication that a connection has been made or broken or the status of a charging operation.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. An electrical connector comprising:

a first cable contact with a mating surface and a retaining surface;

a housing which defines a first passage for receiving the first cable contact, a second passage for mating with a portion of a second cable contact, and a release passage which extends to one end of the first passage;

a retaining device mounted in the first passage, the retaining device engaging with at least a portion of the retaining surface of the first cable contact to detachably retain the first cable contact in the first passage, wherein a width of the retaining device is less than or equal to a width of the first cable contact;

at least one opening formed in the retaining surface of the first cable contact, the opening in the retaining surface is in communication and is substantially aligned with a direction of the release passage; and an auxiliary device mounted in the housing and coupled to one or more cables which are coupled to the first cable contact.

2. The connector as set forth in claim 1 wherein the retaining device is a spring which is biased in a direction towards the retaining surface.

3. The connector as set forth in claim 1 wherein the second cable contact has a mating surface and a retaining surface and the connector further comprising:

another housing which defines a third passage for receiving the second cable contact, a fourth passage for mating with a portion of the first cable contact, and another release passage which extends to one end of the third passage;

another retaining device mounted in the third passage, the retaining device engaging with at least a portion of the retaining surface of the second cable contact to detachably retain the second cable contact in the third passage; and at least other opening formed in the retaining surface of the second cable contact, the opening in the retaining surface is in communication and is substantially aligned with the a direction of the another release passage, wherein the second and fourth passages of the housings can detachably mate to couple the first and second cable contacts together.

4. The connector as set forth in claim 1 wherein the opening extends in along the retaining surface from one end of the first cable contact.

5. The connector as set forth in claim 1 wherein the release passage is formed in and extends in from one end of the housing adjacent to and spaced from the first passage.

6. An electrical connector comprising:

a first cable contact with a mating surface and a retaining surface;

a housing which defines a first passage for receiving the first cable contact and a second passage for mating with a portion of a second cable contact;

a retaining device mounted in the first passage, the retaining device engaging with at least a portion of the retaining surface of the first cable contact to detachably retain the first cable contact in the first passage; and an auxiliary device mounted in the housing and coupled to one or more cables which are coupled to the first cable contact.

7. The connector as set forth in claim 6 wherein the auxiliary device is a battery monitoring device.

8. An electrical connection system comprising:

a first cable contact with a first mating surface and a first retaining surface;

a second cable contact with a second mating surface and a second retaining surface;

a first housing which defines a first passage for the first cable contact, a second passage for mating with a portion of the second cable contact, and a first opening which extends to one end of the first passage;

a second housing which defines a third passage for the second cable contact, a fourth passage for mating with a portion of the first cable contact, and a second opening which extends to one end of the third passage, wherein a portion of the first housing with the second passage detachably mates with a portion of the second housing with the fourth passage to couple the first and second cable contacts together;

a first retaining device mounted in the first passage, the first retaining device engaging with at least a portion of the first retaining surface of the first cable contact to detachably retain the first cable contact in the first passage;

a second retaining device mounted in the second passage, the second retaining device engaging with at least a portion of the second retaining surface of the second cable contact to detachably retain the second cable contact in the third passage;

a first groove formed in the first retaining surface of the first cable contact, the first opening in the first housing is in communication with the first groove;

a second groove formed in the second retaining surface of the second cable contact, the second opening in the second housing is in communication with the second groove; and a lever system pivotally connected to the first and second housings for connecting and disconnecting the first and second housings and the first and second cable contacts.

9. The system as set forth in claim 8 wherein the lever system further comprises:

a first plate secured to the first housing;

a second plate secured to the second housing; and a handle pivotally connected to the first and second plates, wherein the handle has an engaged position where the first and second cable contacts and the first and second housings are connected together and a disengaged position where the first and second cable contacts and the first and second housings are disconnected from each other.

10. The system as set forth in claim 8 wherein the lever system further comprises:

a plate secured to the first housing;

a groove formed in the second housing; and a handle pivotally connected the plate and having a projection which rides in the groove in the second housing, wherein the handle has an engaged position where the first and second cable contacts and the first and second housings are connected together and a disengaged position where the first and second cable contacts and the first and second housings are disconnected.

11. The system as set forth in claim 8 wherein a width of the first retaining device is less than or equal to a width of the first cable contact and a width of the second retaining device is less than or equal to a width of the second cable contact.

12. The system as set forth in claim 8 wherein the first retaining device is a first spring which is biased in a direction towards the first retaining surface and the second retaining device is a second spring which is biased in a direction towards the second retaining surface.

13. The system as set forth in claim 8 further comprising an auxiliary device mounted in at least one of the first and second housings and coupled to one or more cables which are coupled to the first and second cable contacts.

14. The system as set forth in claim 13 wherein the auxiliary device is a battery monitoring device.

15. A method for making an electrical connector, the method comprising:

inserting a first cable contact with a mating surface and a retaining surface in a first passage in a first housing, the first housing having a release passage which extends to one end of the first passage;

engaging the retaining surface of the first cable contact with a first retaining device mounted in the first passage to detachably retain the first cable contact in the first passage, wherein at least one first opening is formed in the retaining surface of the first cable contact, wherein the opening in the retaining surface of the first cable contact is in communication and is substantially aligned with a direction of the release passage, and wherein a width of the first retaining device is less than or equal to a width of the first cable contact; and coupling an auxiliary device in the first housing to the first cable contact.

16. The method as set forth in claim 15 further comprising:

inserting an object in the release passage in the first housing which extends to the first opening;

twisting the object to release the first retaining device from the first cable contact; and withdrawing the first cable contact from the first passage in the first housing.

17. The method as set forth in claim 15 wherein the first retaining device is a spring which is biased in a direction towards the retaining surface of the first cable contact.

18. The method as set forth in claim 15 wherein the opening extends in along the retaining surface from one end of the first cable contact.

19. The method as set forth in claim 15 wherein the release passage is formed in and extends in from one end of the housing adjacent to and spaced from the first passage.

20. The method as set forth in claim 15 further comprising:

inserting a second cable contact with a mating surface and a retaining surface in a second passage in a second housing, the second housing having another release passage which extends to one end of the second passage; and engaging the retaining surface of the second cable contact with a second retaining device mounted in the second passage to detachably retain the second cable contact in the second passage, wherein at least one second opening is formed in the retaining surface of the second cable contact and wherein the second opening in the retaining surface of the second cable contact is in communication and is substantially aligned with a direction of the another release passage.

21. The method as set forth in claim 20 further comprising:

inserting the object in the another release passage in the second housing which extends to the second opening;

twisting the object to release the second retaining device from the second cable contact; and withdrawing the second cable contact from the second passage in the second housing.

22. The method as set forth in claim 20 wherein the first housing has a third passage with a portion of the first cable contact for mating with a portion of the second cable contact and the second housing having a fourth passage with the portion of the second cable contact for mating with the portion of the first cable contact, further comprising detachably mating the third and fourth passages of the first and second housings together to couple the first and second cable contacts together.

23. A method for making an electrical connector, the method comprising:

inserting a first cable contact with a mating surface and a retaining surface in a first passage in a first housing;

engaging the retaining surface of the first cable contact with a first retaining device mounted in the first passage to detachably retain the first cable contact in the first passage;

mounting an auxiliary device in the first housing; and coupling the auxiliary device to at least one cable coupled to at least one of the first and second cable contacts.

24. The method as set forth in claim 23 wherein the auxiliary device is a battery monitoring device.

25. A method for making an electric connection, the method comprising:

inserting a first cable contact with a mating surface and a retaining surface in a first passage in a first housing, the first housing has an opening which extends to one end of the first passage and has a third passage with a portion of the first cable contact for mating with a portion of a second cable contact;

engaging the retaining surface of the first cable contact with a first retaining device mounted in the first passage to detachably retain the first cable contact in the first passage, wherein at least one first groove is formed in the retaining surface of the first cable contact and wherein the opening in the first housing is in communication with the first groove;

inserting the second cable contact with a mating surface and a retaining surface in a second passage in a second housing, the second housing has an opening which extends to one end of the second passage and has a fourth passage with the portion of the second cable contact for mating with the portion of the first cable contact;

engaging the retaining surface of the second cable contact with a second retaining device mounted in the second passage to detachably retain the second cable contact in the second passage, wherein at least one second groove is formed in the retaining surface of the second cable contact and wherein the opening in the second housing is in communication with the second groove; and detachably mating the third and fourth passages of the first and second housings together to couple the first and second cable contacts together;

wherein the detachably mating the third and fourth passages further comprises pivoting a lever system to detachably connect and disconnect the first and second housings and the first and second cable contacts.

26. The method as set forth in claim 25 wherein the lever system further comprises:

a first plate secured to the first housing;

a second plate secured to the second housing; and a handle pivotally connected to the first and second plates, wherein the handle has an engaged position where the first and second cable contacts and the first and second housings are connected together and a disengaged position where the first and second cable contacts and the first and second housings are disconnected from each other.

27. The method as set forth in claim 25 wherein the lever system further comprises:

a plate secured to the first housing;

a groove formed in the second housing; and a handle pivotally connected the plate and having a projection which rides in the groove in the second housing, wherein the handle has an engaged position where the first and second cable contacts and the first and second housings are connected together and a disengaged position where the first and second cable contacts and the first and second housings are disconnected.

28. The method as set forth in claim 25 wherein a width of the first retaining device is less than or equal to a width of the first cable contact and a width of the second retaining device is less than or equal to a width of the second cable contact.

29. The method as set forth in claim 25 wherein the first retaining device is a first spring which is biased in a direction towards the first retaining surface and the second retaining device is a second spring which is biased in a direction towards the second retaining surface.

30. A method for making an electric connection, the method comprising:

inserting a first cable contact with a mating surface and a retaining surface in a first passage in a first housing, the first housing has an opening which extends to one end of the first passage and has a third passage with a portion of the first cable contact for mating with a portion of a second cable contact;

engaging the retaining surface of the first cable contact with a first retaining device mounted in the first passage to detachably retain the first cable contact in the first passage, wherein at least one first groove is formed in the retaining surface of the first cable contact and wherein the opening in the first housing is in communication with the first groove;

inserting the second cable contact with a mating surface and a retaining surface in a second passage in a second housing, the second housing has an opening which extends to one end of the second passage and has a fourth passage with the portion of the second cable contact for mating with the portion of the first cable contact;

engaging the retaining surface of the second cable contact with a second retaining device mounted in the second passage to detachably retain the second cable contact in the second passage, wherein at least one second groove is formed in the retaining surface of the second cable contact and wherein the opening in the second housing is in communication with the second groove;

detachably mating the third and fourth passages of the first and second housings together to couple the first and second cable contacts together;

mounting an auxiliary device in at least one of the first and second housings; and coupling the auxiliary device to at least one cable coupled to at least one of the first and second cable contacts.

31. The method as set forth in claim 30 wherein the auxiliary device is a battery monitoring device.

* * * * *

UNITED STATES PATENT AND TRADEMARK OFFICE

CERTIFICATE OF CORRECTION

PATENT NO. : 6,997,730 B2 
APPLICATION NO. : 10/435801
DATED : February 14, 2006
INVENTOR(S) : Baker et al.

It is certified that error appears in the above-identified patent and that said Letters Patent is hereby corrected as shown below:

Delete Title page illustrating figure(s), and substitute therefor, new Title page illustrating figure(s). (attached)

Delete drawing sheets 1-7, and substitute therefor drawing sheets 1-10 as shown on the attached sheets.

Title Page
Item (74), delete "Nixon Peabody LLP" insert --Maine & Asmus--

Column 3,
Line 16, delete "together" insert --together.--

Column 7,
Line 8, delete "in to" insert --into--

Column 7,
Line 21, delete "in to" insert --into--

Column 7,
Line 55, delete "12(2)" insert --12(2).--

Column 8,
Line 14, delete "system" insert --systems--

Signed and Sealed this

Twenty-seventh Day of February, 2007

JON W. DUDAS
*Director of the United States Patent and Trademark Office*

(12) United States Patent
Baker et al.

(10) Patent No.: US 6,997,730 B2
(45) Date of Patent: Feb. 14, 2006

(54) HIGH CURRENT ELECTRICAL CONNECTOR SYSTEM AND METHODS THEREOF

(75) Inventors: Craig Harold Baker, Shrewsbury, MA (US); Danna Anthony Mancini, Worcester, MA (US); Urs Felix Nager, Hudson, NH (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/435,801

(22) Filed: May 12, 2003

(65) Prior Publication Data

US 2003/0216075 A1 Nov. 20, 2003

Related U.S. Application Data

(60) Provisional application No. 60/381,840, filed on May 17, 2002.

(51) Int. Cl.
*H01R 25/00* (2006.01)

(52) U.S. Cl. ..... 439/295; 439/603; 439/595; 439/744; 439/871; 439/310; 439/284; 439/290

(58) Field of Classification Search ..... 439/744, 439/310, 729, 739, 284, 595, 871, 603, 290, 439/295

See application file for complete search history.

(56) References Cited

U.S. PATENT DOCUMENTS

| | | | | |
|---|---|---|---|---|
| 3,091,746 | A * | 5/1963 | Winkler | 439/295 |
| 3,218,599 | A * | 11/1965 | Winkler | 439/295 |
| 4,083,617 | A * | 4/1978 | Wyatt | 439/295 |
| 4,147,400 | A * | 4/1979 | Snyder, Jr. et al. | 439/744 |
| 4,335,931 | A * | 6/1982 | Kinnear | 439/295 |
| 4,790,777 | A * | 12/1988 | Kincel et al. | 439/744 |
| 5,106,320 | A * | 4/1992 | Kinnear | 439/295 |
| 5,478,250 | A | 12/1995 | Hoffman | |
| 6,077,117 | A | 6/2000 | Iwahori | |
| 6,152,768 | A * | 11/2000 | Beugnot et al. | 439/595 |
| 6,171,146 | B1 | 1/2001 | Fink et al. | |
| 6,179,660 | B1 | 1/2001 | Salaguinto et al. | |

* cited by examiner

*Primary Examiner*—Tho D. Ta
(74) *Attorney, Agent, or Firm*—Nixon Peabody LLP

(57) ABSTRACT

An electrical connector includes a first cable contact with a mating surface and a retaining surface, a housing, a retaining device, and at least one groove. The housing defines a first passage for receiving the first cable contact, a second passage for mating with a portion of a second cable contact, and an opening which extends to one end of the first passage. The retaining device is mounted in the first passage and engages with at least a portion of the retaining surface of the first cable contact to detachably retain the first cable contact in the first passage. The groove is formed in the retaining surface of the first cable contact. The opening in the housing is in communication with the groove.

31 Claims, 8 Drawing Sheets

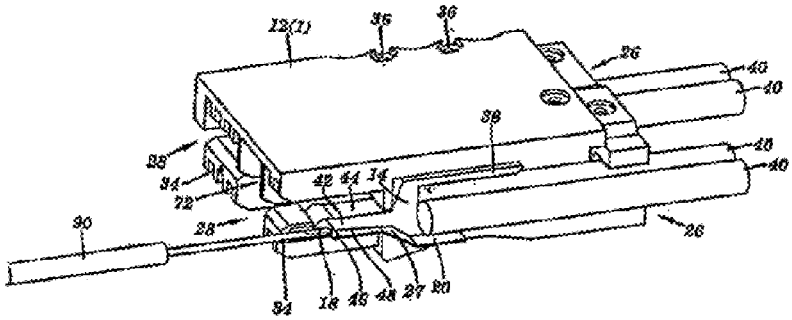

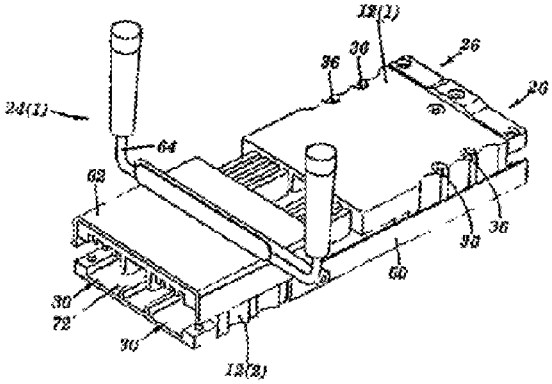

UNITED STATES PATENT AND TRADEMARK OFFICE

CERTIFICATE OF CORRECTION

PATENT NO. : 6,997,730 B2 
APPLICATION NO. : 10/435801
DATED : February 14, 2006
INVENTOR(S) : Baker et al.

It is certified that error appears in the above-identified patent and that said Letters Patent is hereby corrected as shown below:

Delete Title page illustrating figure(s), and substitute therefor, new Title page illustrating figure(s). (attached)

Delete drawing sheets 1-7, and substitute therefor drawing sheets 1-10 as shown on the attached sheets.

Title Page
Item (74), delete "Nixon Peabody LLP" insert --Maine & Asmus--

Column 3,
Line 16, delete "together" insert --together.--

Column 7,
Line 8, delete "in to" insert --into--

Column 7,
Line 21, delete "in to" insert --into--

Column 7,
Line 55, delete "12(2)" insert --12(2).--

Column 8,
Line 14, delete "system" insert --systems--

This certificate supersedes Certificate of Correction issued February 27, 2007.

Signed and Sealed this

Twentieth Day of March, 2007

JON W. DUDAS
*Director of the United States Patent and Trademark Office*

(12) United States Patent
Baker et al.

(10) Patent No.: US 6,997,730 B2
(45) Date of Patent: Feb. 14, 2006

(54) HIGH CURRENT ELECTRICAL CONNECTOR SYSTEM AND METHODS THEREOF

(75) Inventors: Craig Harold Baker, Shrewsbury, MA (US); Danna Anthony Mancini, Worcester, MA (US); Urs Felix Nager, Hudson, NH (US)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/435,801

(22) Filed: May 12, 2003

(65) Prior Publication Data

US 2003/0216075 A1 Nov. 20, 2003

Related U.S. Application Data

(60) Provisional application No. 60/381,840, filed on May 17, 2002.

(51) Int. Cl.
*H01R 25/00* (2006.01)

(52) U.S. Cl. ..... 439/295; 439/603; 439/595; 439/744; 439/871; 439/310; 439/284; 439/290

(58) Field of Classification Search ..... 439/744, 439/310, 729, 739, 284, 595, 871, 603, 290, 439/295

See application file for complete search history.

(56) References Cited

U.S. PATENT DOCUMENTS

| | | | | |
|---|---|---|---|---|
| 3,091,746 | A * | 5/1963 | Winkler | 439/295 |
| 3,218,599 | A * | 11/1965 | Winkler | 439/295 |
| 4,083,617 | A * | 4/1978 | Wyatt | 439/295 |
| 4,147,400 | A * | 4/1979 | Snyder, Jr. et al. | 439/744 |
| 4,335,931 | A * | 6/1982 | Kinnear | 439/295 |
| 4,790,777 | A * | 12/1988 | Kincel et al. | 439/744 |
| 5,106,320 | A * | 4/1992 | Kinnear | 439/295 |
| 5,478,250 | A | 12/1995 | Hoffman | |
| 6,077,117 | A | 6/2000 | Iwahori | |
| 6,152,768 | A * | 11/2000 | Beugnot et al. | 439/595 |
| 6,171,146 | B1 | 1/2001 | Fink et al. | |
| 6,179,660 | B1 | 1/2001 | Salaguinto et al. | |

* cited by examiner

*Primary Examiner*—Tho D. Ta
(74) *Attorney, Agent, or Firm*—Nixon Peabody LLP

(57) ABSTRACT

An electrical connector includes a first cable contact with a mating surface and a retaining surface, a housing, a retaining device, and at least one groove. The housing defines a first passage for receiving the first cable contact, a second passage for mating with a portion of a second cable contact, and an opening which extends to one end of the first passage. The retaining device is mounted in the first passage and engages with at least a portion of the retaining surface of the first cable contact to detachably retain the first cable contact in the first passage. The groove is formed in the retaining surface of the first cable contact. The opening in the housing is in communication with the groove.

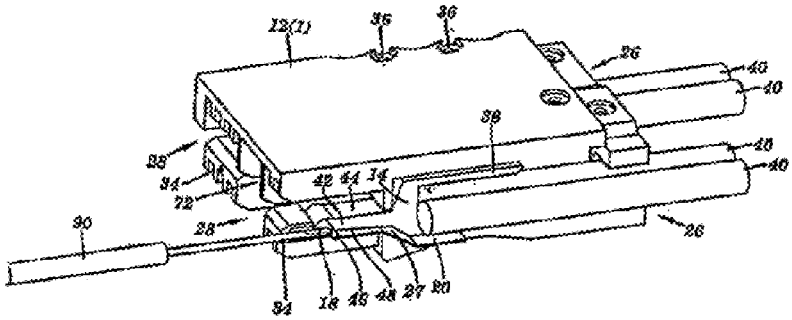

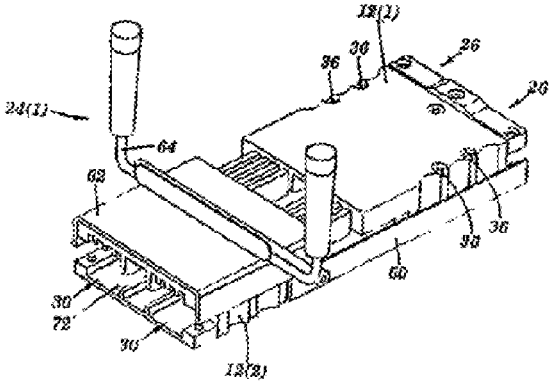

31 Claims, 8 Drawing Sheets